US005487489A

United States Patent [19]

Weiss et al.

[11] Patent Number: 5,487,489

[45] Date of Patent: *Jan. 30, 1996

[54] PUMP DISPENSER WITH MOVABLE BOTTLE

[75] Inventors: Stephan Weiss, 211 E. 70th St., New York, N.Y. 10021; David Seidler, Forest Hills, N.Y.

[73] Assignee: Stephan Weiss, New York, N.Y.

[ * ] Notice: The term of this patent shall not extend beyond the expiration date of Pat. No. 5,377,869.

[21] Appl. No.: 342,888

[22] Filed: Nov. 21, 1994

Related U.S. Application Data

[60] Division of Ser. No. 111,291, Aug. 24, 1993, Pat. No. 5,377,869, which is a continuation-in-part of Ser. No. 938,889, Aug. 31, 1992, abandoned, and a continuation-in-part of Ser. No. 937,656, Aug. 27, 1992, Pat. No. Des. 352,890, and a continuation-in-part of Ser. No. 936,253, Aug. 27, 1992, Pat. No. Des. 353,993.

[51] Int. Cl.[6] ..... B67D 5/64

[52] U.S. Cl. ..... 222/1; 222/162; 222/183

[58] Field of Search ..... 222/1, 160, 162, 222/182, 183, 321, 181.1, 321.1, 321.7, 321.9, 321.8

[56] References Cited

U.S. PATENT DOCUMENTS

| | | | |
|---|---|---|---|
| D. 94,036 | 12/1934 | Loesch | D9/448 |
| D. 219,706 | 1/1971 | Elias | D9/300 |
| D. 254,838 | 4/1980 | Agnone et al. | D9/300 |
| D. 274,471 | 6/1984 | Widmer | D24/100 |
| D. 309,860 | 8/1990 | Fossati | D9/300 |
| 2,673,008 | 3/1954 | Ryan | 222/162 |
| 2,904,223 | 9/1959 | Ryan | 222/162 |
| 2,914,222 | 11/1959 | Meshberg | 222/162 |
| 2,966,283 | 12/1960 | Darvie | 222/183 |
| 3,272,391 | 9/1966 | Meshberg | 222/162 |
| 3,310,830 | 3/1967 | Gattone . | |
| 3,506,004 | 4/1970 | Mann et al. . | |
| 3,516,424 | 6/1970 | Eagle . | |
| 3,658,209 | 4/1972 | Freeman et al. | 222/335 X |
| 4,765,515 | 8/1988 | Lippman | 222/162 |
| 4,834,083 | 5/1989 | Byram et al. | 222/162 X |
| 4,860,738 | 8/1989 | Hegemann et al. | 222/162 X |
| 5,377,869 | 1/1995 | Weiss et al. | 222/162 X |

FOREIGN PATENT DOCUMENTS

| | | |
|---|---|---|
| 315809 | 5/1989 | European Pat. Off. . |

*Primary Examiner*—Kevin P. Shaver
*Attorney, Agent, or Firm*—Curtis, Morris & Safford

[57] ABSTRACT

Disclosed are dispensers for dispensing a liquid from a vessel having a pump nozzle and methods for dispensing a liquid by moving the bottle towards a pump nozzle. The dispenser is provided with a housing for the bottle, a pump nozzle which is set in a substantially stationary position in the housing and a mechanism to move the bottle towards the pump nozzle so as to cause liquid to dispense from the nozzle. The dispensers of the invention are suitable for dispensing liquid, such as spraying fragrances. The dispensers of the invention are especially suited for portable, purse-or pocket-sized fragrance dispensers.

15 Claims, 13 Drawing Sheets

PUMP DISPENSER WITH MOVABLE BOTTLE

RELATED APPLICATIONS

This application is a continuation application Ser. No. 08/111,291, filed Aug. 24, 1993, now U.S. Pat. No. 5,377,869, which in turn is a continuation-in-part of application Ser. No. 07/938,889, filed Aug. 31, 1992, now abandoned, which incorporated herein by reference. This application Ser. No. 08/111,291 is also a continuation-in-part of U.S. applications Ser. Nos. 07/937,656 and 07/936,253, filed Aug. 27, 1992, entitled, "Ornamental Design for Dispenser or Bottle Therein or Similar Article", incorporated herein by reference now U.S. Pat. Nos. 352,890 and 353,993.

FIELD OF THE INVENTION

The present invention relates to a dispenser for a liquid, more particularly, a pump-type dispenser such as, a dispenser for a fragrance, perfume, Eau de Parfum, toilet water, cologne or the like. The dispenser is preferably sized to be portable so it fits in a pocket or a purse; and the vessel or bottle which fits within the dispenser and contains the fragrance is designed to be movable, towards the spray nozzle, for dispensing the fragrance.

BACKGROUND OF THE INVENTION

Dispensers for liquids, particularly fragrances, are varied. Perfumes are dispensed from open-mouthed bottles, but, open-mouthed bottles do not allow the user to apply the fragrance gently as a spray.

Conventional spray-type dispensers include an atomizer which usually has a squeeze-bulb to force gas into a bottle which causes liquid in the bottle to rise within a tube disposed in the liquid and spray from a nozzle. Akin to the atomizer is a pump spray dispenser which usually has a pump nozzle which the user depresses, thereby forcing gas into a stationary bottle (with respect to the nozzle). This causes liquid in the bottle to rise within a tube disposed in the liquid and spray from the nozzle. The nozzle-pump of a pump spray dispenser is typically positioned at the top of the bottle. Pump spray dispensers are used to dispense perfume, Eau de Parfum, cologne or toilet water. Such a dispenser can be sized to be portable, for instance, to be carried in a pocket or purse.

Scent, the result of applying a perfume or Eau de Parfum, is a personal and unique possession. Indeed, the wearer's sense in herself, a feeling of being comfortable, an "invisible bodysuit", may come from her fragrance. Thus, different and novel scents are desired as contents of a perfume or Eau de Parfum dispenser.

In many ways a different and novel dispenser, preferably for perfume, Eau de Parfum or the like, is also desired. The appearance, dress, or ornamental design of a perfume or Eau de Parfum dispenser is desirably aesthetically pleasing. It can function as identifying the source or origin of the product, to distinguish the product from those of others, and, to convey an image. The dispenser can present a statement regarding the perfume or Eau de Parfum, as well as the wearer. Indeed, like the fragrance, the dispenser can give the wearer a sense in herself, a comfortable feeling.

However, meeting the need for expanding the range of designs for dispensers has been hampered by the functional limitation of the pump spray dispenser, namely, that the pump nozzle must be depressed to spray the liquid. This has generally dictated the positioning of the pump spray nozzle, that is, the device the user interacts with to cause the liquid to dispense as a spray. More particularly, the pump spray nozzle must be depressed thereby dictating that the spray nozzle be at the "top" of the dispenser. Indeed, it may dictate a particular symmetry for the dispenser, for instance, a radial symmetry. A typical spray dispenser for a fragrance stands on a substantially flat bottom which can rest on a surface with the pump spray nozzle being activated by a downward force applied to the pump spray nozzle. Such a dispenser can also be hand-held with the user's finger applying downward pressure on the pump spray nozzle from the top of the dispenser while holding the dispenser.

The invention meets the need for expanding the range of dispenser designs by providing a pump dispenser wherein the activator can be other than at the top of the dispenser. However, "top" activated dispensers are not necessarily excluded from within the scope of the invention. In the dispenser of the invention, the activation of the pump nozzle is not necessarily accomplished by directly depressing the pump nozzle. Additionally, the location of the pump nozzle on the dispenser is not necessarily dictated by the fact that the pump nozzle has to be activated by a downward pressure on the pump nozzle. Rather, a separate activator for the pump nozzle can be located at places other than the top of the housing. Furthermore, the invention provides a dispenser in which activation of the pump nozzle is accomplished at least in part by movement of the vessel, for instance, a bottle, containing the liquid to be dispensed, toward the pump nozzle which stays directed where the user pointed it. In this instance, the user can accurately point the dispenser and gently squeeze it to dispense a liquid.

Providing a dispenser wherein the activator location is novelly positioned, and, providing a dispenser wherein the bottle moves toward the pump nozzle, presents certain obstacles which are overcome by the simple design of the present invention.

For example, a separate activator can be placed at a side or bottom of the housing apart from the pump nozzle by providing a mechanism which translates force applied to the activator to move the bottle towards the pump nozzle. Also, if the bottle is to be refilled, the mechanism is designed with sufficient simplicity and a minimum of parts so that an average consumer can disassemble and reassemble the dispenser. Thus, movement of the bottle is accomplished with elegant simplicity and few mechanical parts.

OBJECTS AND SUMMARY OF THE INVENTION

It is therefore an object of the invention to provide a novel dispenser.

It is an object of the invention to provide a dispenser, the design of which is not dictated by a pump nozzle which requires activation by the application of a downward force directly on the pump nozzle.

It is an object of the invention to provide a dispenser which is refillable and is simple to assemble and disassemble.

It is an object of the invention to provide a dispenser which permits a wide range of design possibilities not dictated by the operation of the pump nozzle.

It is also an object of the invention to provide a dispenser which is suitable for dispensing a fragrance or scent such as perfume, Eau de Parfum, cologne, toilet water or the like.

It is yet another object of the invention to provide a dispenser wherein the bottle moves toward the pump nozzle to cause liquid to spray or be delivered from the nozzle.

It is yet a further object of the invention to provide a dispenser wherein the angle between said axis of the activating force applied by the user and the axis of the spray from the nozzle is not necessarily about 90° or about 270° (depending upon the direction of the activating force), but rather can be substantially about 0° or 180° (depending upon the direction of the activating force) or can be greater than 270° but less than 90° or greater than 90° but less than 270° such as between about 345° and about 80° between about 120° and about 215°.

Thus, the present invention provides a dispenser for dispensing a liquid from a pump nozzle bottle having a pump nozzle from which liquid dispenses, the dispenser including a housing for the bottle wherein the pump nozzle is set in at least a substantially stationary position, and, a mechanism to move the bottle toward the pump nozzle so as to cause the liquid to dispense from the pump nozzle. Thus, pumping is effected by moving the bottle towards the at least substantially stationary pump nozzle wherein the pump is compressed and the liquid is dispensed. Preferably, the pump nozzle is stationary. Also, preferably the pump nozzle is a pump spray nozzle.

In one embodiment, the mechanism which moves the bottle towards the nozzle comprises means which receives an activating force to operate the pump nozzle while it remains substantially stationary by translating that activating force or a component of it to a force which moves the bottle towards the pump nozzle. In another embodiment, the activating force or a component of it is translated to an upward force along an imaginary axis running through approximately the center of the pump nozzle, or parallel thereto.

In a further embodiment, an activating force is applied at about the outer surface of the dispenser and the activating force or a component of it is translated to the upward force by a mechanism within the dispenser. The activating force is at an angle $\theta$ to the upward force or to the imaginary axis, for example, $\theta$ can be $0° \leqq \theta \leqq 180°$, such as $30° \leqq \theta \leqq 150°$ or, $60° \leqq \theta \leqq 120°$; and preferably $75° \leqq \theta \leqq 105°$, more preferably $80° \leqq \theta \leqq 100°$, most preferably $\theta$ is about 90°. Additionally, the activating force is applied to the outer surface of the dispenser. Thus, it is preferred that when $\theta$ is 0° or 180° the activating force is applied other than directly to the top of the pump nozzle.

In another embodiment, an activating force is applied at the outer surface of the dispenser along a first axis and the activating force or a component of it is translated to the upward force by a mechanism within the dispenser such that fluid within the dispenser dispenses along a second axis. The angle between the axes is greater than 270° but less than 90° or greater than 90° but less than 270°. The angle is preferably between about 345° and about 80° or between about 120° and 215°. Preferably the pumping axis of the spray nozzle is substantially perpendicular to the dispensing axis.

In yet another embodiment the means to translate the activating force to the upward force comprises at least one spring lever within the housing operatively connected to, or preferably, contacting the bottle. For instance, the bottle is connected to a spring lever and the activating force compresses or flexes the spring lever in the housing to apply an upward force on the bottle.

In a further embodiment, the mechanism which moves the bottle towards the pump nozzle comprises a spring lever, means in the housing to mount the spring lever, means on or in the bottle to connect the spring lever to the bottle, and a movable push bar in the housing connected to the spring lever. The activating force is pressure upon the push bar which causes the spring lever to compress or flex, thereby applying the force to move the bottle towards the pump nozzle.

In a preferred embodiment of the invention the means which moves the bottle toward the pump nozzle includes a flexible spring lever having a cut-out, a first end and a second end. The first end of the spring lever is positioned against a nib in the housing. A groove of the bottle is matingly positioned in the spring lever cut-out, and the second end of the spring lever is positioned against a moveable push bar in the housing. When sufficient pressure is applied against the push bar, the spring lever compresses or flexes, and provides a force against the groove of the bottle causing the bottle to move towards the pump nozzle. As the pump nozzle is compressed, liquid dispenses from the nozzle. Preferably, the liquid dispenses as a spray.

In a further preferred embodiment, the dispenser has a first face from which the liquid dispenses, and a second face which is substantially opposite the first face and which contains the movable push bar.

In yet a further preferred embodiment, the groove or means to receive at least one spring lever is provided in an upper portion of the bottle. The groove and the spring lever is curved such that the center section of the curve is raised above its ends. The spring lever is positioned and held between a nib in the housing and a push bar which is positioned at the opposite side or face of the housing from the nib. The push bar is movable on a hinge set in the housing. The hinge is preferably positioned near the top of the housing, in proximity to where the pump nozzle is set in place. This can allow for a variety of angles for the activating force.

The other end of the push bar is held in the housing by second and third nibs protruding substantially perpendicularly to the direction of motion of the push bar which form a guide or slot within which an extension on the end of the push bar slides to allow the push bar to stay in track. Alternatively, the housing near that end of the push bar is provided with a slotted guide within which the extension can move as the activating force is applied to the push bar. The slotted guide is preferably rectangular in shape.

The lower portion of the inside of the housing can have a fourth nib on which the bottle rests before it is moved upward. The fourth nib can also or alternatively act as part of a snap closure for the housing. Other protruding nibs can be placed on the interior surface of the push bar to assist in placement of the spring lever.

The pump nozzle may be set in a substantially stationary position by providing a cavity in the housing within which the pump nozzle fits. The bottle and the housing interior may have some conformity in shape. The housing can be openable into first and second parts which are connected by, for example, a hinge. In addition, while the invention includes a dispenser in which the pump nozzle is substantially set and the bottle moves towards it, the dispenser can also include embodiments wherein both the pump nozzle and bottle can move.

Alternative embodiments provide for rollers, a flexible member, or a cam positioned at the lower portion at the bottle and activated by force upon the push bar to cause the bottle to move towards the pump nozzle.

The invention also provides methods for dispensing a liquid by moving a bottle in a housing towards a pump nozzle which is held in at least a substantially stationary position within the housing.

These and other objects and embodiments of the invention are provided in, or are obvious from, the following detailed description of the invention.

BRIEF DESCRIPTION OF THE DRAWINGS

In the following detailed description of the invention, reference will be made to the accompanying drawings, wherein.

DETAILED DESCRIPTION

Figure 1:
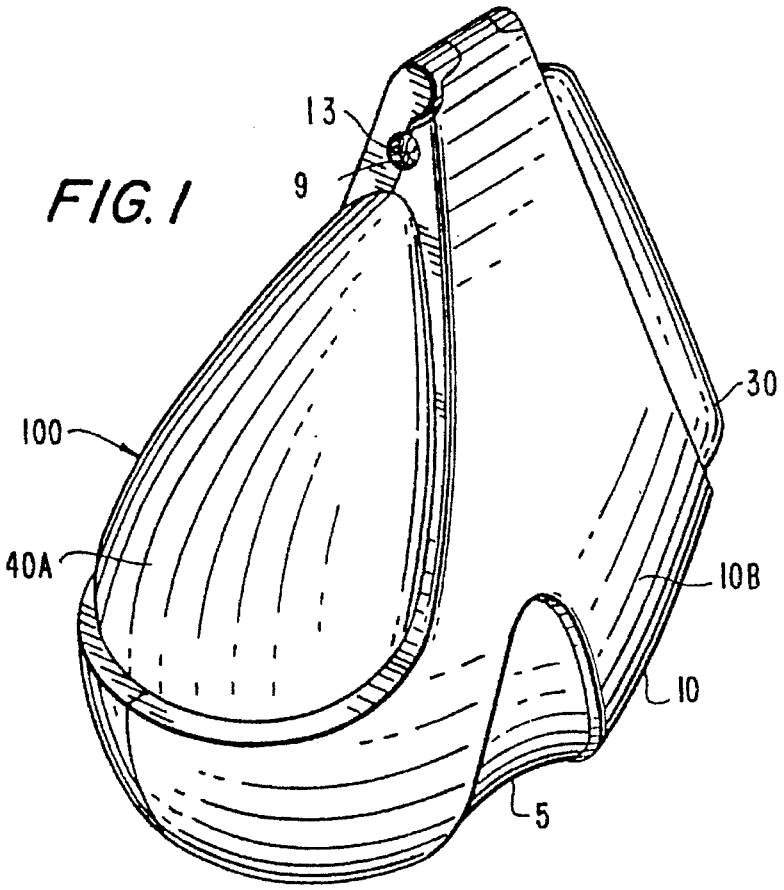
FIG. 1 shows a top front and right side perspective view of a dispenser of the invention.

Reference is made to all of the Figures herein as preferred embodiments, dispensers 1, 100, 100', 100", 100'", 1000, 1000', 1000" and 1000'" are illustrated As will be appreciated from the following, dispensers 1, 100, 100', 100", 100'", 1000, 1000', 1000" and 1000'" achieve movement of a bottle 15, 15", 15, 1015, 1015', 1015" or 1015'" towards a pump nozzle 13 with elegant simplicity and few mechanical parts. It will be further appreciated that in dispensers 1, 100, 100', 100", 100'", 1000, 1000" and 1000'" there is a freedom of design in the shape of housings such as 10, 10' and 10". Also, it is not necessary that the location of the activator (e.g., push bar 30) be at the "top" (FIG. 2) of the dispenser, e.g., dispenser 100.

Figure 2:
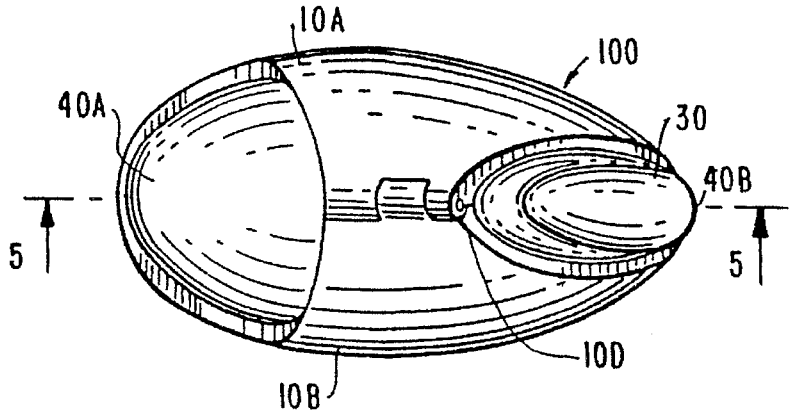
FIG. 2 shows a top plan view of a dispenser of the invention.
Figure 3:
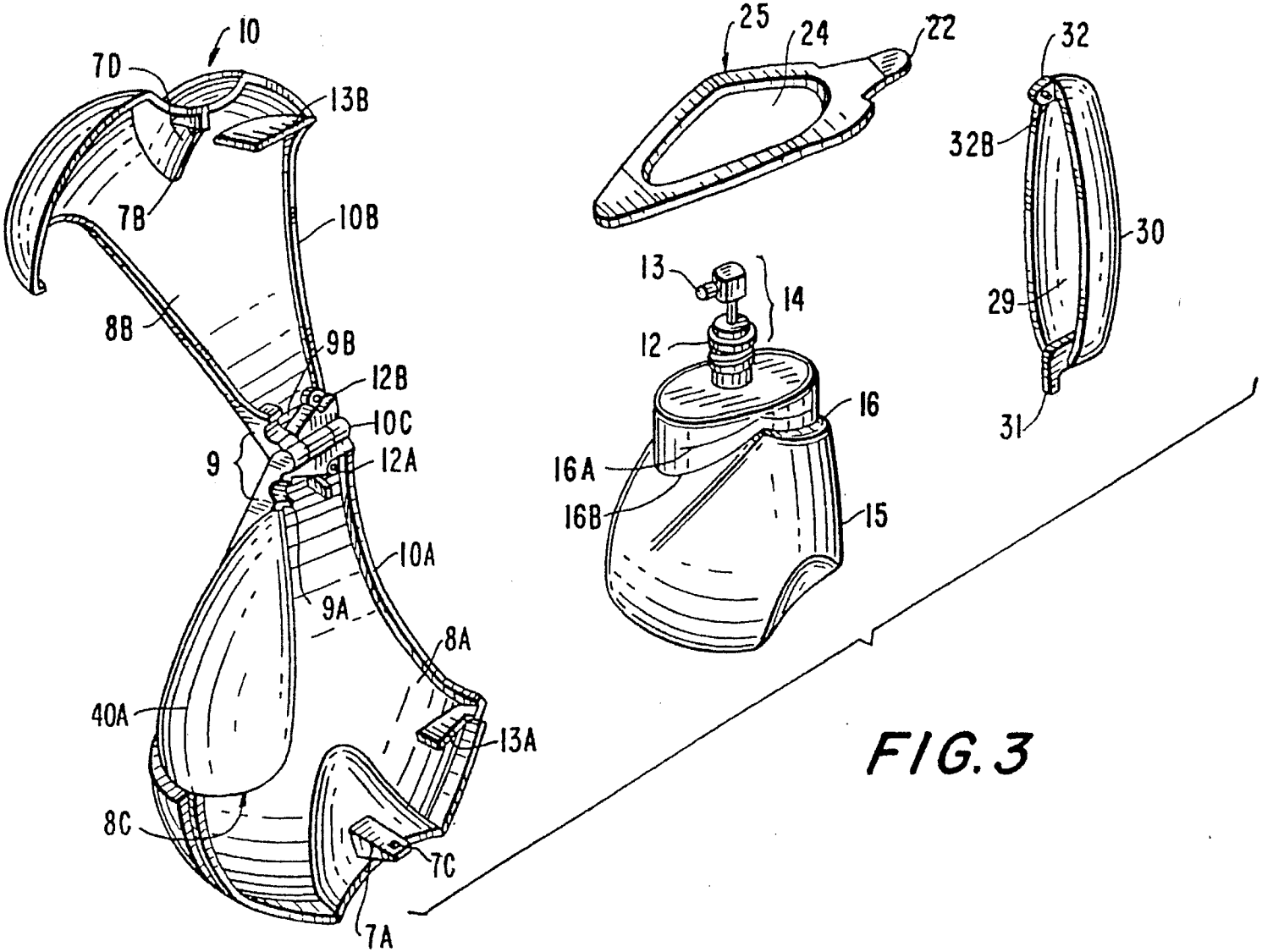
FIG. 3 shows an exploded perspective view of a dispenser of the invention.

Referring to FIGS. 1 and 2, dispenser 100 includes a housing 10 made up of two housing halves 10A and 10B which are depicted in the closed position. Housing half 10A also includes a curved face 40A in the front of the dispenser 100. Groove 5 is provided in the bottom of dispenser 100 in both housing halves 10A and 10B. Push bar 30, which is moveable to activate pump spray nozzle 13, is fitted between housing halves 10A and 10B at the rear portion of dispenser 100. Push bar 30 forms a curved face 40B at the rear portion of dispenser 100. The two housing halves 10A and 10B are hinged together at hinge pin 10D. Pump spray nozzle 13 is positioned so as to fit in circular cut out 9 in the upper portion of dispenser 100.

Referring to FIGS. 3, 4, 5, 6 and 7 to 10, dispenser 100 is shown in the opened position or in cross section. Dispenser 100 contains a cavity defined by inner surfaces 8A, 8B and 8C of housing 10. Bottle 15 is positioned inside the cavity which is shaped to receive bottle 15. The cavity is defined by inner surface 8B of housing half 10B, inner surface 8A of housing half 10A and inner surface 8C of face 40A.

Bottle 15 has pump spray nozzle assembly 14 which includes pump spray nozzle 13 and screw cap 12 which connects pump spray nozzle assembly 14 to bottle 15. Housing 10 is provided with a circular cut-out area 9 which is formed when cut-out areas 9A and 9B in the upper portion of housing halves 10A and 10B, respectively, are brought together by closing housing halves 10A and 10B. Pump spray nozzle 13 is positioned in circular cut-out area 9. Circular cut-out area 9 provides stationary positioning of pump spray nozzle 13 within housing 10.

Figure 5:
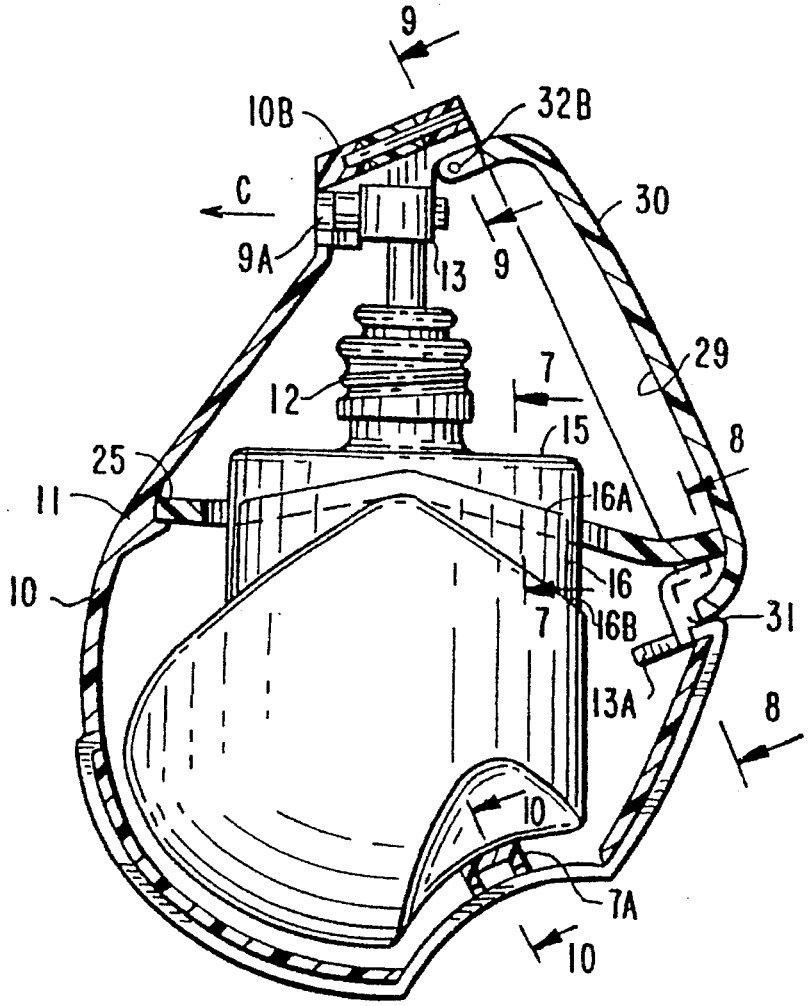
FIG. 5 shows a cross-sectional view along the lines 5—5 of FIG. 2.

Each side of bottle 15 further includes a curved groove 16 which fits within cut-out 24 of spring lever 25. Spring lever 25 also contains first end 23 and second end 22. As shown in FIG. 5, bottle 15, by groove 16 thereof, is matingly positioned though cut-out 24 of spring lever 25 such that first end 23 is against nib 11 on the inner surface 8C of face 40A and second end 22 contacts the interior surface 29 of push bar 30. The central portion of spring lever 25 is slightly curved in the direction it flexes or compresses, that is, toward pump spray nozzle 13. Below nib 11, a perpendicular reinforcement for nib 11, nib 11A (FIG. 11) can also be provided on the inner surface 8C of face 40A.

Figure 7:
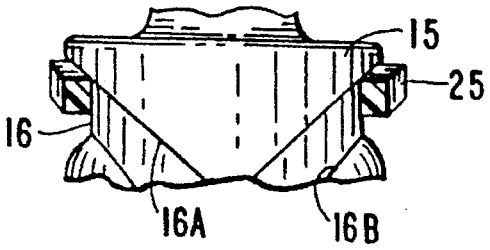
FIG. 7 shows a partial cross-sectional view taken along lines 7—7 of FIG. 5.

Also shown in FIGS. 5 and 7, groove 16 has upper and lower surfaces 16A and 16B, respectively. Spring lever 25 contacts upper surface 16A and, the area between surfaces 16A and 16B (groove 16) defines an area for positioning spring lever 25.

Rather than using a single spring lever 25 which is attached to bottle 15 by being positioned in groove 16, alternate means may be employed. For instance, bottle 15 can be provided with protrusions rather than a groove. Also, the spring lever 25 can be a separate spring lever for each side of bottle 15 or can be more than one spring lever.

Housing 10 has clam-shell-like housing "halves" 10A and 10B which are connected at hinge 10C by hinge pin 10D. The term "halves" is used liberally as the portions of the housing need not be exactly "halves" of the housing. Indeed, as illustrated, housing halves 10A and 10B are not each a half of the housing, for example, since housing half 10A contains face 40A. Thus, the "halves" need only be portions so that as is preferred, housing 10 may be opened. Any means to connect portions of the housing so that it is openable may be employed. The portions of the housing may simply snap fit together or the "hinge" can be provided by a flexible piece of plastic connecting the two halves. Further, housing 10 may be provided to the user in a sealed, non-openable condition but, the openable condition is preferred, so that bottle 15 can be refilled.

Figure 8:
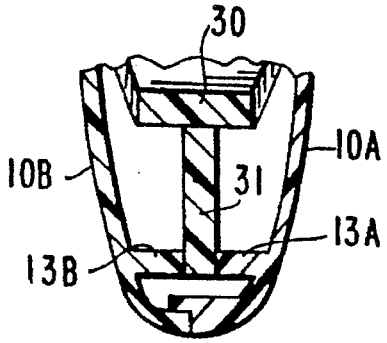
FIG. 8 shows a partial cross-sectional view taken along lines 8—8 of FIG. 5.
Figure 9:
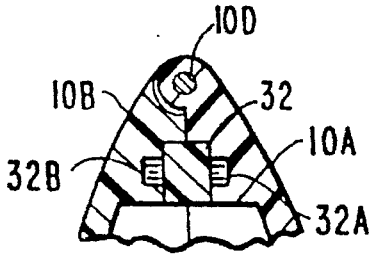
FIG. 9 shows a partial cross-sectional view taken along lines 9—9 of FIG. 5.

As shown in FIGS. 3, 4, 5, 6, 8 and 9, each housing half 10A and 10B in the rear section of dispenser 100 in the area proximate push bar 30 has openings 12A and 12B in the upper portion of that section, as well as protruding nibs 13A and 13B in the lower portion of that section. Push bar 30 has extension 31 and extension 32. Extension 32 in the upper portion of push bar 30 has pin 32A and pin 32B extending from each side. Pin 32A fits into opening 12A. Likewise, pin 32B fits into opening 12B. Thus, as depicted in FIG. 9, push bar 30 is hinged to housing 10 when housing halves 10A and 10B are closed. In addition, as shown in FIG. 8, extension 31 in the lower portion of push bar 30 sits in a slot between nibs 13A and nib 13B which is formed when housing halves 10A and 10B are closed so as to allow push bar 30 to stay in track.

Figure 11:
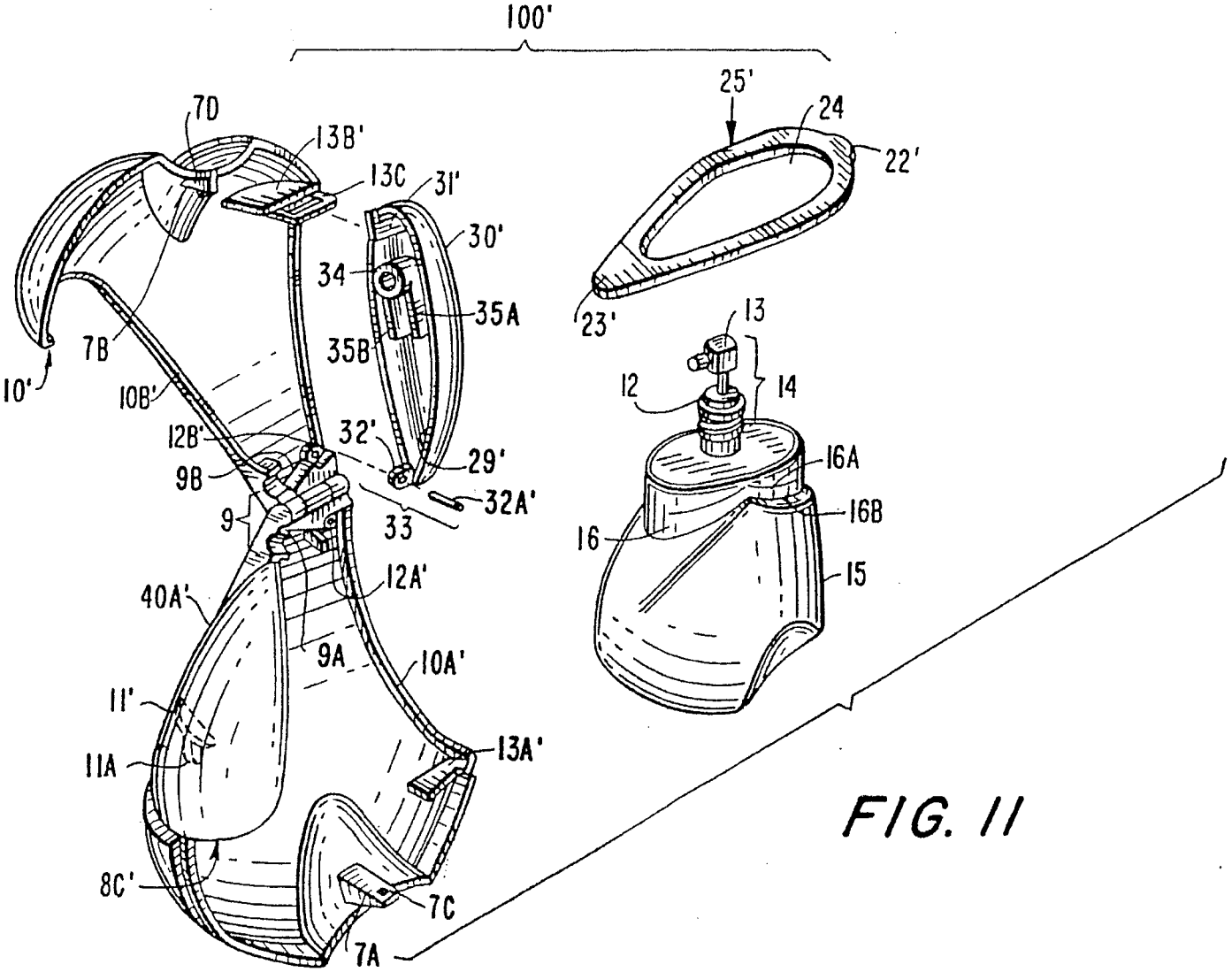
FIG. 11 shows an exploded perspective view of a dispenser of the invention depicting an alternate design for affixing the push bar to the dispenser.

Alternatively, as shown in FIG. 11, push bar 30' has a hinge 33 formed by a pin 32A' passing through and extending from each side of extension 32'. Pin 32A' can be formed from metal. One side of metal pin 32A' fits into opening 12B'. Likewise, the other side of metal pin 32A' fits into opening 12A' when housing halves 10A' and 10B' are closed. In FIG. 11 also, the lower portion of push bar 30' containing extension 31' sits in a rectangular slot 13C formed in nib 13B'. Nib 13B' rest next to nib 13A' when housing halves 10A' and 10B' are closed to keep push bar 30' in track. In this alternate embodiment push bar 30' is held by hinge 33 and the rectangular slot 13C in nib 13B' to housing half 10B' when dispenser 100' is opened. In this embodiment, when housing halves 10A' and 10B' are closed, the second end 22' of spring lever 25' is held in place on the interior surface 29' of push bar 30' by resting against a circular protrusion 34 on interior surface 29. To assist spring lever 25' in its movement, extending upwardly from circular protrusion 34 are slots 35A and 35B on the interior surface 29' of push bar 30'. Additionally, in this alternative embodiment first end 23' of spring lever 25', when in housing half 10A', rests against a nib 11' (analogous to nib 11 of dispenser 100). Below nib 11' a perpendicular reinforcement, nib 11A is also provided on the inner surface 8C' of face 40A' of housing half 10A'.

Of course, other means to movably attach push bar 30 to housing 10 can be employed. More generally, push bar 30 can be replaced by other means, for example, a slidable bar which permits the user to apply pressure so as to activate the internal spring mechanism of the invention.

Figure 4:
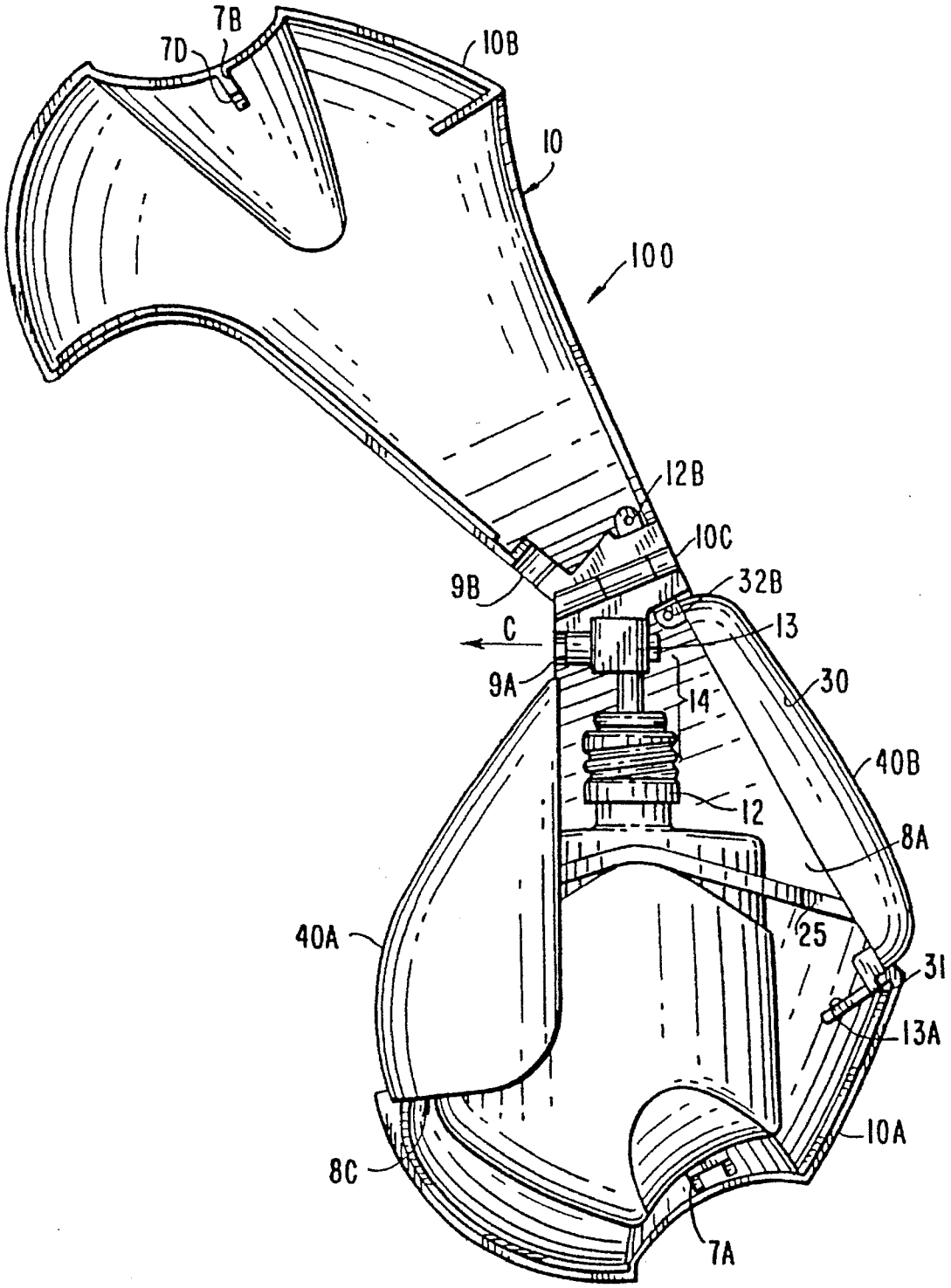
FIG. 4 shows a side view of a dispenser of the invention in the open condition.
Figure 10:
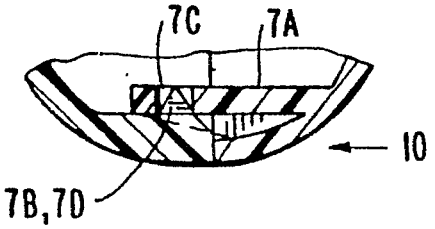
FIG. 10 shows a partial cross-sectional view taken along lines 10—10 of FIG. 5.

Referring to FIGS. 4, 5 and 10, the interior of housing 10A in the area of groove 5 contains ledge 7A which is used to support bottle 15 in its lowermost position in dispenser 100. To effect closure of housing halves 10A and 10B, housing half 10B in the area of groove 5 is provided with nib 7B having a tip 7D which fits within opening 7C in ledge 7A so that halves 10A and 10B snap closed (FIG. 10).

Push bar 30 forms a face 40B at the rear section of dispenser 100, and, opposite that face is the face 40A in the front of dispenser 100 from which the liquid spray dispenses (the direction of which is shown by arrow C). Thus, the dispenser of the invention can have a first face from which spray dispenses, and a second face opposite the first face wherein the movable push bar is located at substantially the second face.

In operation, when halves 10A and 10B are closed, with push bar 30 and spring lever 25 in place, sufficient activating pressure or force is applied to push bar 30, push bar 30 pivots on pins 32A and 32B and moves in as extension 31 at the lower end of push bar 30 moves in the slot between nibs 13A and 13B. The inward motion of push bar 30 flexes or compresses spring lever 25. Spring lever 25 translates the activating force to an upward lifting force and moves upward in groove 16 in the area between surfaces 16A and 16B, contacting upper surface 16A, causing bottle 15 to lift upward. Lifting bottle 15 toward pump spray nozzle 13, which is held in place in cut-out area 9 formed by cut-out areas 9A and 9B, provides the pumping action required to dispense liquid in bottle 15 as spray from pump spray nozzle 13 in the direction of arrow C (FIG. 4). The activating force can be applied by holding dispenser 100 or 100' in a hand, with pump spray nozzle 13 directed at the point at which spray is desired and, squeezing the dispenser push bar 30.

Figure 6:
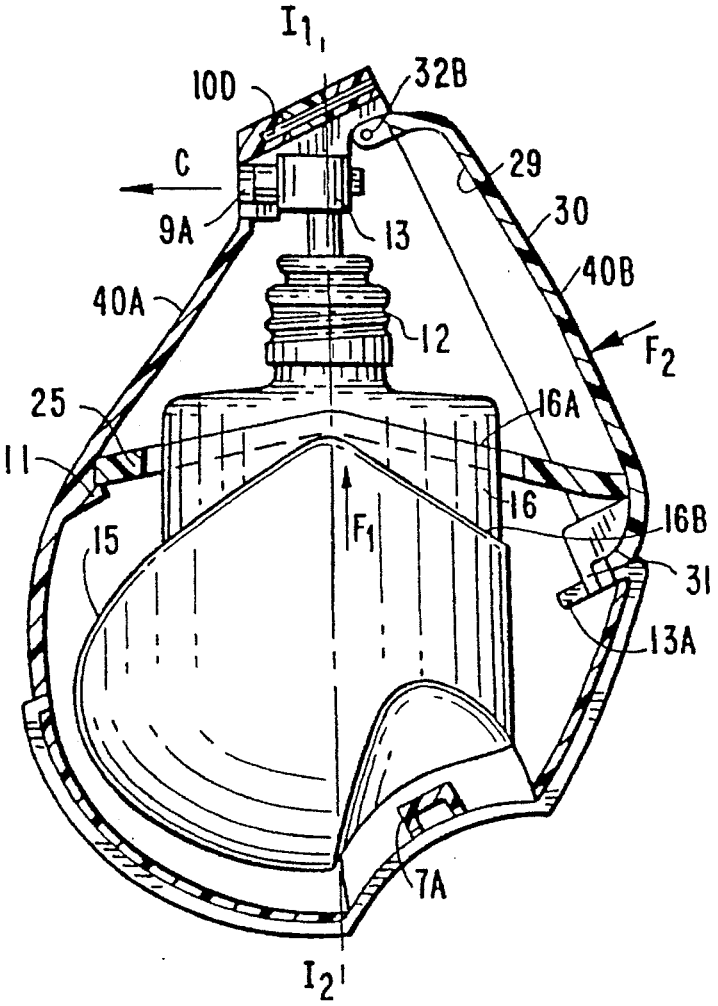
FIG. 6 shows a view similar to that of FIG. 5 in the dispensing position.

Push bar 30 or some other type of spray activator such as a button, a slide or a flexible plastic material, can be located at different points around and about the outside surface of dispenser 100 to interact with a mechanism, such as the spring lever 25, to move bottle 15 towards the substantially stationary pump spray nozzle 13. Thus, one using dispenser 100 can press the spray activator with a force which will be translated either directly or through some mechanism such as the spring lever 25, to a force which moves bottle 15 toward the pump spray nozzle 13. In FIG. 6, line $I_1$–$I_2$ represents an imaginary axis running through bottle 15 and through pump spray nozzle 13. Arrow $F_1$ indicates the direction of force on the bottle and arrow $F_2$ indicates the direction of the activating force applied to push bar 30. Depending on the location of push bar 30 or another type of spray activator such as a button or a flexible polymeric material, force $F_2$ can substantially coincide with $F_1$, along the line $I_1$–$I_2$ such that the angle θ, the angle between $F_1$ and $F_2$, is 0° or, force $F_2$ can be at an angle to force $F_1$ wherein for example, the angle θ between $F_2$ and $F_1$, can be $0° \leqq \theta \leqq 180°$, such as $30° \leqq \theta \leqq 150°$, or, $60° \leqq \theta \leqq 120°$; and preferably $75° \leqq \theta \leqq 105°$, more preferably $80° \leqq \theta \leqq 100°$, most preferably about 90°.

Figure 6A:
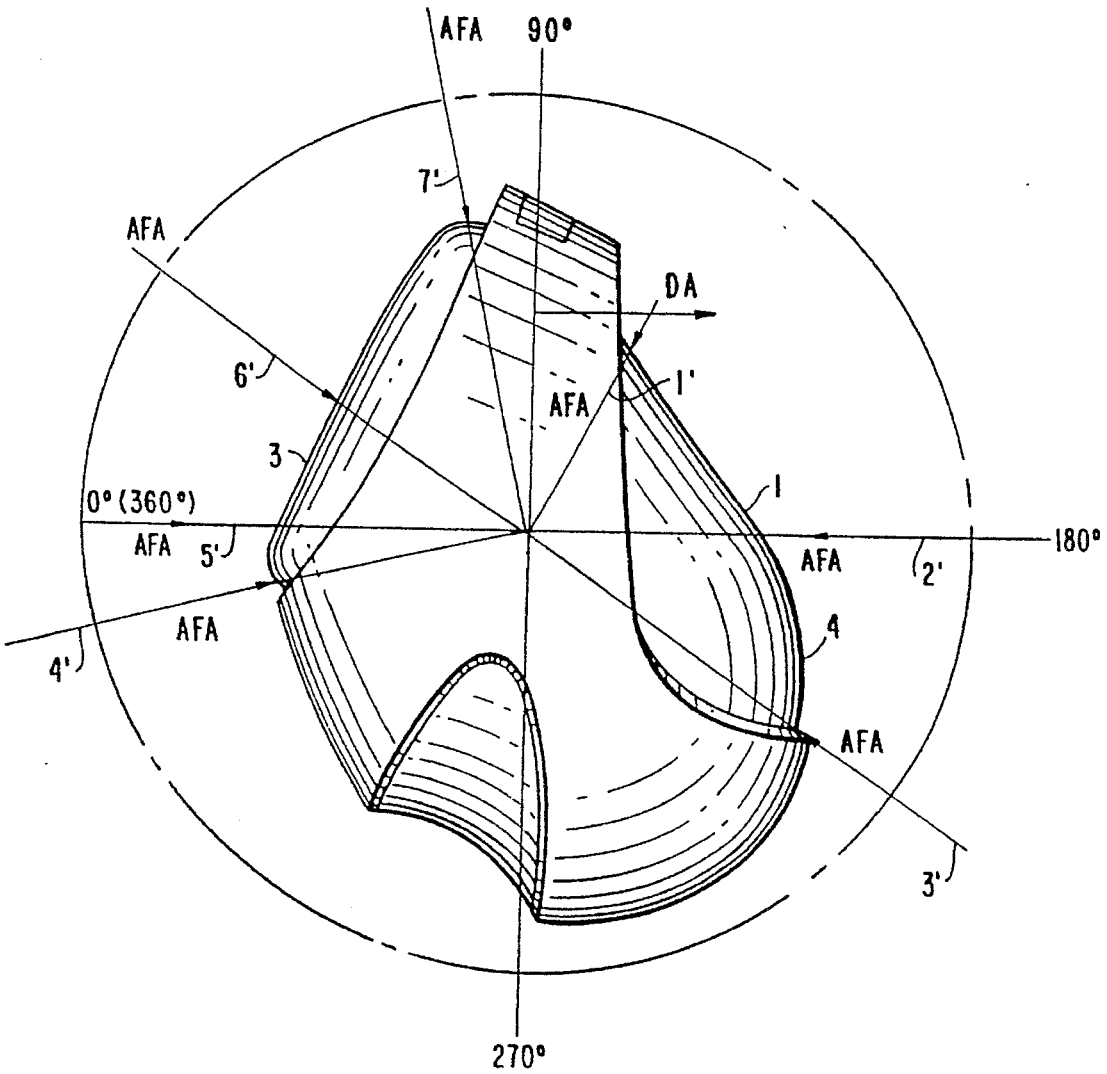
FIG. 6A shows various angles between the actuating force axis and dispensing axis of dispensers of the invention.

Considering FIG. 6A which is applicable to all embodiments illustrated, dispenser 1 (common to all illustrated dispensers) has a 360 degree axis superimposed upon it, with the dispensing axis indicated as DA. (Of course, in use the liquid dispenses as a spray around axis DA, for instance, as shown in FIGS. 14, 15, 17, 19 and 21). The typical actuating force applied by the user is shown along any of axes 1' to 7', also indicated as AFA. The angle between an actuating force axis (AFA) and the dispensing axis (DA) can be greater than 90° but less than 270° or greater than 270° but less than 90°. For instance, the angles between DA and AFA 1' to 7' are:

| AFA | Angle between AFA and DA |
|---|---|
| 1' | about 120° |
| 2' | about 180° |
| 3' | about 215° |
| 4' | about 345° |
| 5' | about 0° (360°) |

-continued

| AFA | Angle between AFA and DA |
|---|---|
| 6' | about 30° |
| 7' | about 80° |

Thus, when the push bar is face 3 (e.g., push bar 30), the angle between axes DA and AFA can be between about 345° and about 80° and, when the push bar is face 4 (see FIGS. 4A, 13–19), the angle between axes DA and AFA can be between about 120° to about 215°. The AFA axes are akin to force $F_2$ in other Figures. The DA axis is akin to C in other Figures. Further, considering FIGS. 1 to 6 and 7 to 12, the pumping axis of pump spray nozzle 13 (force $F_1$ in FIG. 6) is substantially perpendicular to the dispensing axis DA, C.

As illustrated, the user can access the bottle, e.g., bottle 15, 15", 115, 1015, 1015" or 1015'" within the dispenser, e.g., dispenser 100, 100', 100", 100'", 1000, 1000', 1000" or 1000'" for, example, to replace or refill bottle. In order to open the dispenser such as dispenser 100 or 1000, when it is closed, it is held with push bar 30 or face 300 facing the user's right. By firmly pressing in groove 5 on the exterior surface of housing 10, the internal clasp, nib 7B with tip 7D mating opening 7C, is released and "clam-shell-like" housing halves 10A and 10B separate. Housing half 10B can be lifted away from housing half 10A exposing the bottle. However, both housing halves 10A and 10B remain hinged together at hinge 10C. By grasping the bottle or the spring lever 25 (in embodiments having both), the bottle and spring lever 25 can be removed from housing 10. The pump spray nozzle assembly, for instance pump spray nozzle 14, unscrews at screw cap 12 from the bottle, e.g., bottle 15 to permit refilling of the bottle. Pump spray nozzle assembly 14 is then screwed onto the top of bottle at screw cap 12 so as to avoid leakage and, the bottle e.g., bottle 15 with spring lever 25 is returned to the interior of housing 10, with pump spray nozzle 13 facing away from push bar 30 or face 300 and spring lever 25 (if present) accordingly in place. The clam-shell-like housing halves 10A and 10B are then gently snapped together so that tip 7D of nib 7B fits into opening 7C to close housing 10 with the bottle suitably positioned therein.

Likewise, if one decides to replace the bottle, e.g., bottle 15 in the dispenser, e.g., dispenser 100, one need only lift the bottle or the bottle and spring lever 25 (in embodiments having both) from housing half 10A, remove spring lever 25 by lifting it out of groove 16 and up over spray nozzle assembly 14 and place spring lever 25 on a new bottle. That new bottle or the new bottle and spring lever 25 are then returned to housing half 10A and housing 10 is closed.

While the invention has been described with respect to use as a fragrance dispenser, it is to be understood that the invention can be used to dispense any liquid, including viscous liquids such as creams, lotions, soaps, gels and the like. Of course, with viscous liquids the pump nozzle is suited for dispensing such liquids. Thus, the viscous liquid may not necessarily dispense as a spray, but rather as a squirt, stream or drops. Of course, since the invention is particularly suited for use as a fragrance, cream, lotion, soap or gel, especially fragrance, dispenser, the pump nozzle need not dispense a metered dose or amount of fluid as in medicament dispensers, but, this is not to say that the invention cannot be used to dispense medicaments as the liquid within the dispenser is not necessarily a limitation of the invention.

It is to be further understood that any utilitarian description herein of any component of the dispenser of the invention, for example the exterior of the housing or any groove thereon or the bottle or any feature, e.g., groove thereon, is not to be construed as a statement that the appearance of any component of the invention is functional in nature or dictated by function. Surface ornamentation or configuration of the dispenser or any components thereof, for example, the exterior of the housing or of the bottle or any portion thereof, are attributable to ornamental considerations.

The housing including the push bar, is preferably formed from a substantially rigid material, including metals, glass, plastics and thermoplastics, preferably polypropylene. Spring lever 25 too can be formed from any suitable materials, including metals, plastics and thermoplastics, preferably polypropylene or stainless steel. These components can be manufactured by any processes such as molding, injection molding, blow molding and injection blow molding, preferably injection molding.

Likewise, the bottle can be made from any suitable material, including glass, metal, plastics or thermoplastics. Glass is presently preferred as it does not generally absorb the components of or impart contaminants to a fragrance. The bottle can be manufactured by any process such as molding, injection molding, blow molding and injection molding. As mentioned earlier, the invention is especially suited for a portable or pocket or purse-size dispenser, for example a "purer". Thus, in a preferred embodiment in a purser-type dispenser, the bottle holds about 15 ml of liquid. The bottle is preferably non-collapsible, or at least sufficiently rigid so as to be moved as described.

The pump spray nozzle assembly 14 can be a conventional type such as those available from Valois of America, Inc., 15 Valley Drive, Greenwich, Conn. The pump spray nozzle assembly 14 preferably screws onto the bottle, fits within a cavity in the housing, and dispenses substantially perpendicularly to the pumping axis of the pump spray nozzle. In such pump spray nozzle assemblies, the portion which attaches to the bottle is typically formed of metal, while other portions such as the tubes and nozzle are plastic or thermoplastic.

Since the dispenser is particularly suited for use as a purser it is preferred that spring lever 25 be formed of a material which is sufficiently flexible so as to allow compression when sufficient pressure is applied to the push bar, e.g., push bar 30, but, which is also sufficiently rigid so as to prevent accidental spray when unintended pressure is applied to the push bar, for instance, when the dispenser is jostled within the purse.

To avoid accidental spray, the push bar, e.g., push bar 30, will encounter some resistance from spring lever 25 before spring lever 25 is flexed enough to activate the pump spray nozzle assembly 14. In the illustrated embodiment f FIGS. 1 to 4, 5, 6 and 7 to 11, it is preferred to allow about 0.5 to 3 mm, most preferably about 1 to 2 mm of movement of the push bar before there is activation. In the embodiments of FIGS. 4A and 12 to 21 the leaf springs, spring members and/or spring within the pump spray nozzle provide sufficient resistance for the push bar or the mechanism can, allow about 0.5 to 3 mm, preferably about 1 to 2 mm of push bar movement before there is activation, to avoid accidental spray. Alternatively, or additionally, the dispenser can be provided with a cap (not shown). The cap can matingly fit within or over nozzle 13, or within cut-out area 9 in the of the housing proximate to the nozzle so that the cap prevents accidental spray. The cap can be hingedly connected to the housing, for example, a flip cap. Accidental spray can also be prevented by providing an overcap or lock for the push bar so as to prevent its movement. For instance, a slidable lock (not shown) can be provided to prevent the push bar, e.g., push bar 30' (FIG. 11), from moving, such as within rectangular slot 13C. Additionally or alternatively, accidental spray can be prevented by providing means to prevent spring lever 25 from compressing or flexing until desired, or to prevent bottle 15 from moving towards pump spray nozzle 13 until desired.

Other mechanisms can be employed within a housing to move a bottle towards a pump nozzle. For instance, although not illustrated, a spring assembly can be positioned near the bottom of the bottle with an appropriate lever mechanism or push button on housing 10 to activate the spring assembly to move bottle 15 toward pump spray nozzle 13. Considering and modifying the illustrated embodiment shown in FIG. 6, the spring assembly and lever mechanism or push button can be positioned at or near illustrated ledge 7A. The spring assembly can keep tension on the push button or lever mechanism. Thus, the push button or lever mechanism can be positioned such that the angle between the activating force $F_2$ and the upward force $F_1$ is small or 0°. A spring may be positioned in the upper section of housing 10 to assist the spring within the pump nozzle in returning the bottle to its lowermost position within the housing.

Alternatively, an internal, substantially "L-shaped", spring-tensioned, lever which is activated slidably can be employed instead of spring lever 25 and push bar 30. The spring-tensioned "L-shaped" lever which replaces spring lever 25 can contact a bottom portion of the bottle. A slide means, which replaces push bar 30, on the surface of housing 10 moves the lever to push bottle 15 towards spray pump nozzle 13 to dispense the liquid spray. The spring is biased to move the lever back to its original position and thereby move bottle 15 away from spray pump nozzle 13. A second spring may also be positioned in the housing above bottle 15 to assist the spring within the pump nozzle in returning bottle 15 to this lower position.

Figure 12:
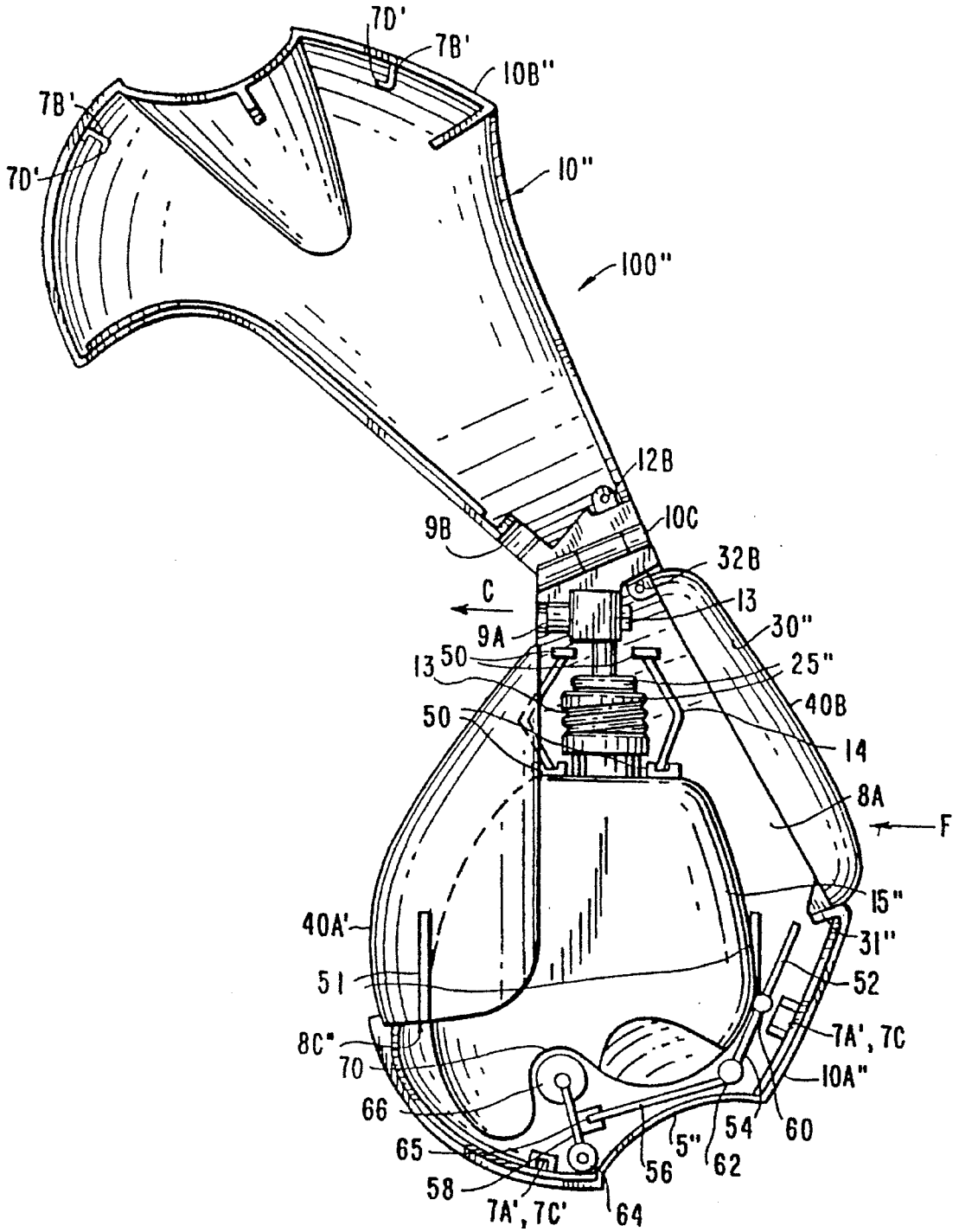
FIG. 12 shows a side view of a dispenser of the invention in the open condition, including an alternate design for the mechanism for moving the vessel towards the pump nozzle.

An alternate embodiment, dispenser 100", is depicted in FIG. 12. Mountings 50 are fixed in the upper portion of housing half 10A", below cut-out 9A, and on bottle 15". Springs 25" are positioned between mountings 50 in housing half 10A" on either side of pump spray assembly 14. Stabilizers 51 are located in the lower portion of housing half 10A" on each side of bottle 15" to assist in preventing lateral movement of bottle 15". In particular, one stabilizer 51 is on the inner surface 8C" of face 40A" and the other stabilizer 51 is located on the opposite side of housing half 10A" on inner surface 8A.

A series of bars and rollers activated by push bar 30" are used to move bottle 15" toward pump spray nozzle 13. Extension 31" at the lower portion of push bar 30" extends to bar 52. Bar 52 is connected to bar 54 in the lower portion of housing half 10A" at movable joint 60. Bar 54 is connected to bar 56 in the lower portion of housing half 10A", beneath bottle 15" at movable joint 62 Bar 56 extends to and fits into cup shaped connection 65 which is connected to bar 58. Roller 64 is at the lower end of bar 58, contacting an inner surface of housing half 10A" beneath bottle 15", near the end of groove 5" which is closest to inner surface 8C". The upper end of bar 58 is provided with roller 66 contacting groove 70 at the bottom of bottle 15". Dispenser 100" opens at the two snap closures formed by a pair of nibs 7A' each having an opening 7C' which are located at the bottom of housing half 10A" and, by a corresponding pair of nibs 7B' each having a tip 7D' which are located at the bottom of housing half 10B". Tips 7D' mate with openings 7C' when housing halves 10A" and 10B" are in a closed position.

In operation of dispenser 100", force F is applied to push bar 30" causing extension 31" to move into bar 52. As bar 52 moves downwardly, joint 60 flexes resulting in bar 54 moving downwardly. The downward movement of bar 54 flexes joint 62 and causes bar 56 to move towards bar 58, thereby moving roller 64 along inner surface 8C". The motion of roller 64 provides an upward force on bar 58 and roller 66 pushing against bottle 15" at groove 70. This causes bottle 15" to move towards spray nozzle 13, thereby providing a pumping motion to spray dispense liquid from bottle 15" from spray nozzle 13. Thus, joint 60 and roller 64 each act as a fulcrum. When force F is released from push bar 30" springs 25" push bottle 15" downward thereby causing roller 64, bars 52, 54, 56 and push bar 30" to return to their original position. In addition, dispenser 100" is openable for refilling or replacing bottle 15" by squeezing the bottom of dispenser 100", near groove 5" so as to cause tips 7D' to disengage from openings 7C'.

FIGS. 4A and 13 to 19 show further alternative embodiments of the invention. In these embodiments that which was the push bar in the earlier-described embodiments, e.g., push bar 30, is face 300, fixed at points 320 and 310 (extensions 31 and 32 in the earlier-described embodiments) and face 40A is movably attached push bar 400, 400' 400" or 400'", movable and attached to the upper portion of the housing, by means of hinge 32" below the orifice from which spray dispenses. Push bar 400, 400', 400" or 400'" is adjacent face 40A' of housing half 10A and face 40A" of housing half 10B'. Thus, extension 31 in earlier embodiments (see, e.g., FIG. 4) is fixed, for instance, in the slot between nibs 13A and 13B, in the embodiments of FIGS. 4A and 13 to 19, and, pin 32A (see, e.g., FIG. 4) is set, for instance in opening 12A. Components which are common or similar to the earlier-described embodiments are numbered similarly or as in those earlier embodiments.

Figure 4A:
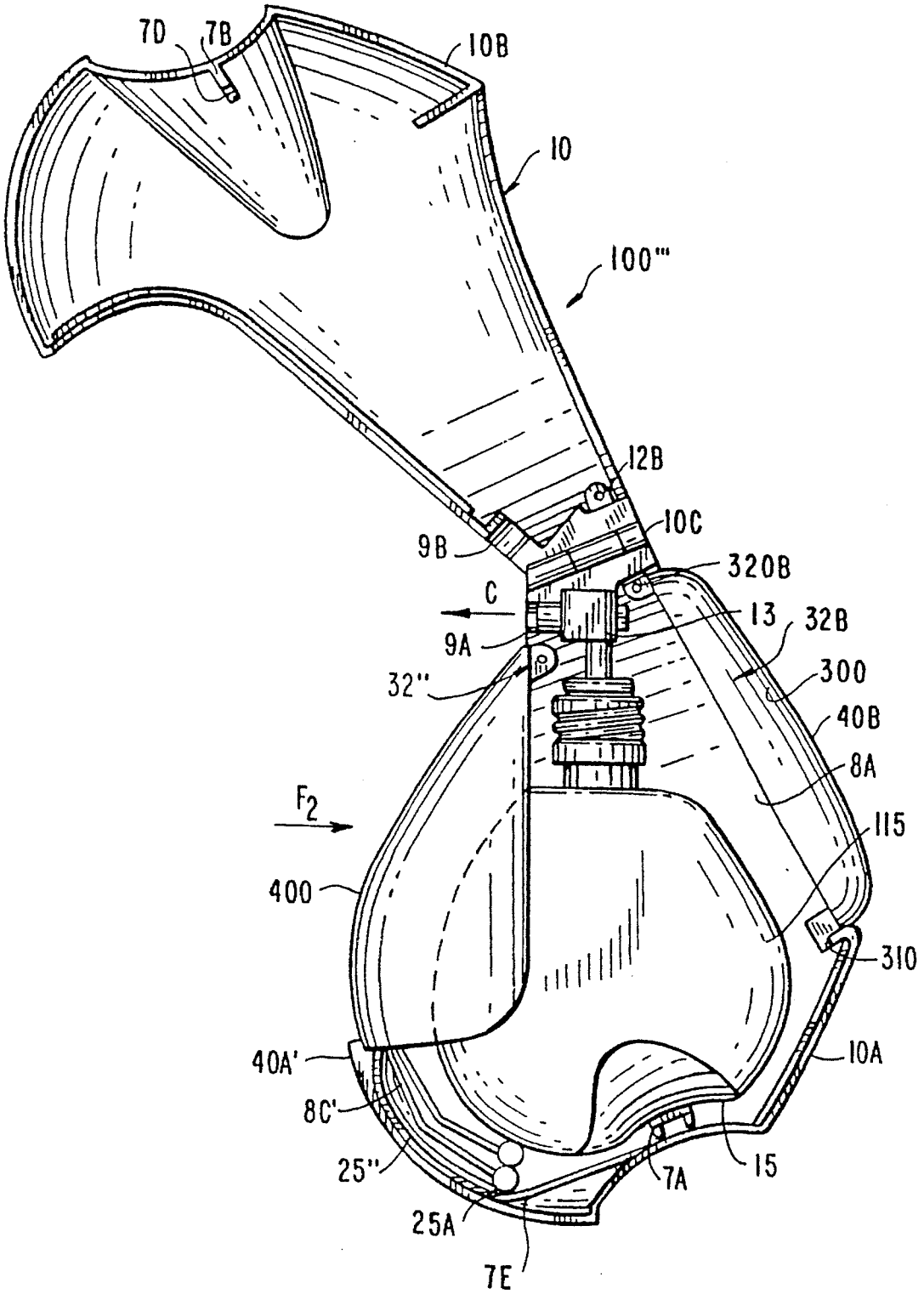
FIG. 4A shows a side view of an alternative dispenser of the invention in open condition.

Considering FIG. 4A which shows an open cross-sectional view of an alternative embodiment which is similar to the embodiment depicted in FIG. 4, attached to the lower portion of push bar 400 are arms 25". Arms 25" extend into the lower portion of dispenser 100'", each terminating at an attached roller 25A, one of which rests against the lower portion 15A of bottle 115 and, the other of which rests against platform 7E positioned in the lower portion of housing half 10A. Platform 7E extends along the bottom of housing half 10A from ledge 7A in a direction generally toward push bar 400. In operation, the user applies force ($F_2$) to push bar 400 which pivots at hinge 32" and moves away from face 40A' and towards bottle 115. Rollers 25A move in the direction of force $F_2$, against lower bottom portion 15A and platform 7E. The space between lower bottom portion 15A and platform 7E narrows in the direction of force $F_2$. Thus, as rollers 25A move, they-cause bottle 115 to rise within dispenser 100'" actuating pump spray nozzle 13, from which liquid dispenses in the direction of arrow C. The spring within spray nozzle 13 causes bottle 115 to return to its original position upon release of force $F_2$. Of course, leaf springs as in FIG. 12 or a spring lever as in FIGS. 3, 4, 5, 6 or 11, or both, can also be added to the embodiment of FIG. 4A to assist the spring within spray nozzle 13.

Figure 15:
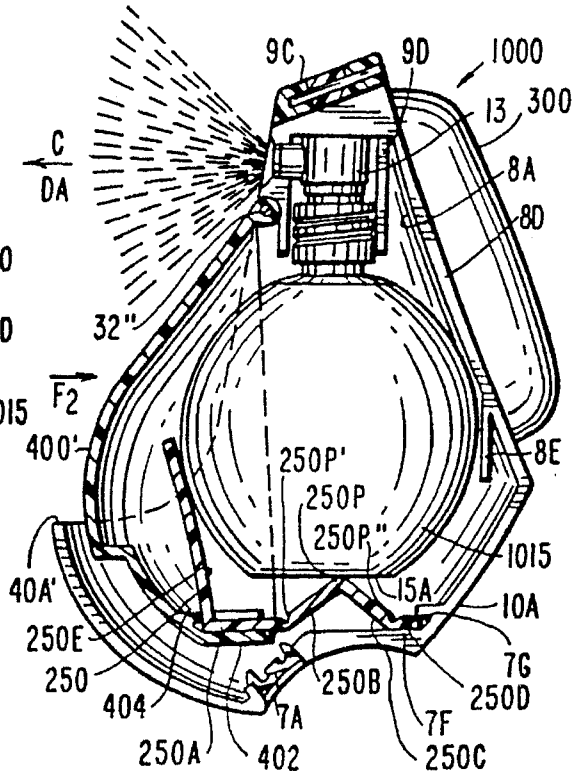
FIGS. 13 to 15 show open side views of a dispenser of the invention, including yet a further alternative design for moving the vessel towards the pump nozzle and, the dispenser in ordinary and operational conditions.
Figure 14:
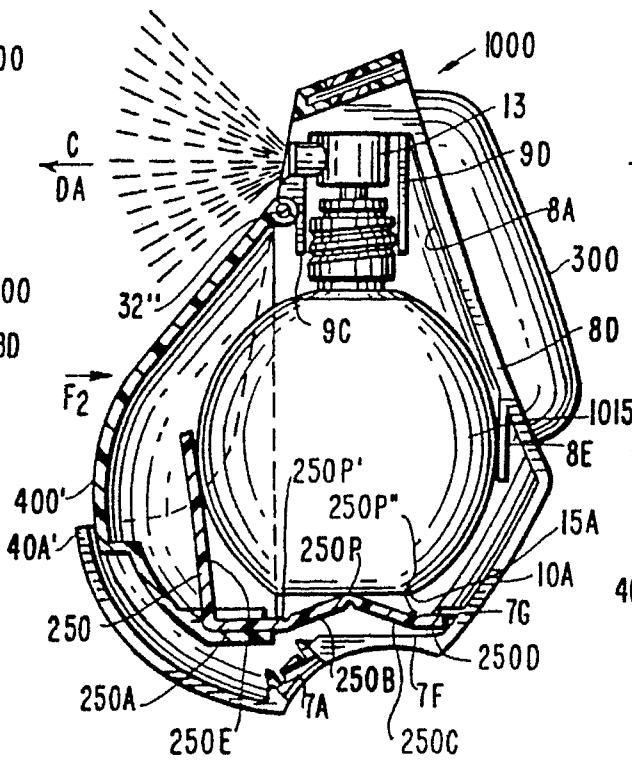
Figure 13:
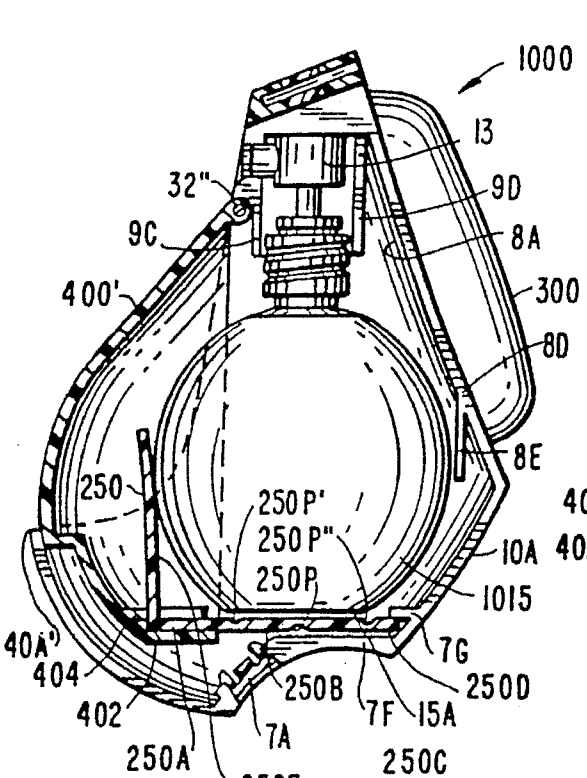

FIGS. 13 to 15 show another alternative embodiment in an open, cross-sectional, view, with FIG. 13 showing dispenser 1000 at rest and, FIGS. 14 and 15 showing dispenser 1000 in operational condition. In the embodiment of FIGS. 13 to 15, face 300 (push bar 30 in earlier-described embodiments) is fixed along edge 8D of housing half 10A. Adjacent edge 8D is ledge 9D. Spray nozzle 13 is positioned between ledge 9D and a second ledge, ledge 9C, in the upper portion of housing half 10A. Ledge 9C is adjacent hinge 32" about which pivots push bar 400' in response to force $F_2$.

Push bar 400', at its lower portion, has ledges 402 and 404, between which sits a horizontal portion (250A) of flexible lever 250. Rising perpendicularly from portion 250A is vertical portion 250E which rests against a side of bottle 1015, holding bottle 1015 between vertical portion 250E and ledge 8E which extends down from the lower part of edge BE. Portions 250A, 250B, 250C and 250D of flexible lever 250 are flexibly connected in series, with portions 250B, 250C and 250D extending from portion 250A, below bottle 1015. In FIG. 13, portions 250B, 250C and 250D are in the same plane as portion 250A, with portions 250B and 250C resting between bottom face 15A of bottle 1015 and platform 7F positioned at the bottom of housing half 10A, adjacent ledge 7A. Portion is 250D set between platform 7F and a ledge, ledge 7G. Thus, flexible lever 250 is set in place by portion 250A set between ledges 402 and 404, portion 250D set between platform 7F and ledge 7G, portion 250E resting against bottle 1015 and, portions 250B and 250C between bottom face 15A and platform 7F.

Flexible lever 250 flexes at notched points 250P, 250P' and 250P" in response to force $F_2$ such that between portions 250A and 250D (i.e., at portions 250B and 250C), flexible lever 250 compresses upwardly with point 250P pushing upwardly against bottle 1015 causing it to rise toward nozzle 13 which accordingly dispenses (C, DA), as shown, in FIGS. 14 and 15. Thus, in operation, force $F_2$ causes push bar 400' to move away from face 40A' and, causes flexible lever 250 to compress pushing bottle 1015 upwardly. To accomplish this, the notches between respectively portions 250A and 250B at point 250P" and 250C and 250D at point 250P' are cut in the upper face of flexible lever 250 and, the notch between portions 250B and 250C at point 250P is cut in the lower face of flexible lever 250. To assist bottle 1015 in so moving upwardly, bottle 1015 rests against portion 250E which is providing a force upon the bottle as a result of force $F_2$ and, at the side of bottle 1015 opposite that which rests against portion 250E, bottle 1015 rests against ledge 8E of housing half 10A. The compression of the bottle between ledge 8E and portion 250E assists in translating force $F_2$ to an upward motion of bottle 1015. Upon release of force $F_2$, the spring within spray nozzle 13 causes bottle 1015, push bar 400', flexible lever 250 and the portions thereof to return to their original position (FIG. 13). Of course, the spring within spray nozzle 13 may also be assisted by leaf springs or a spring lever, or both. If held upright, the weight of bottle 1015 can also assist in the return to original position (FIG. 13).

Figure 17:
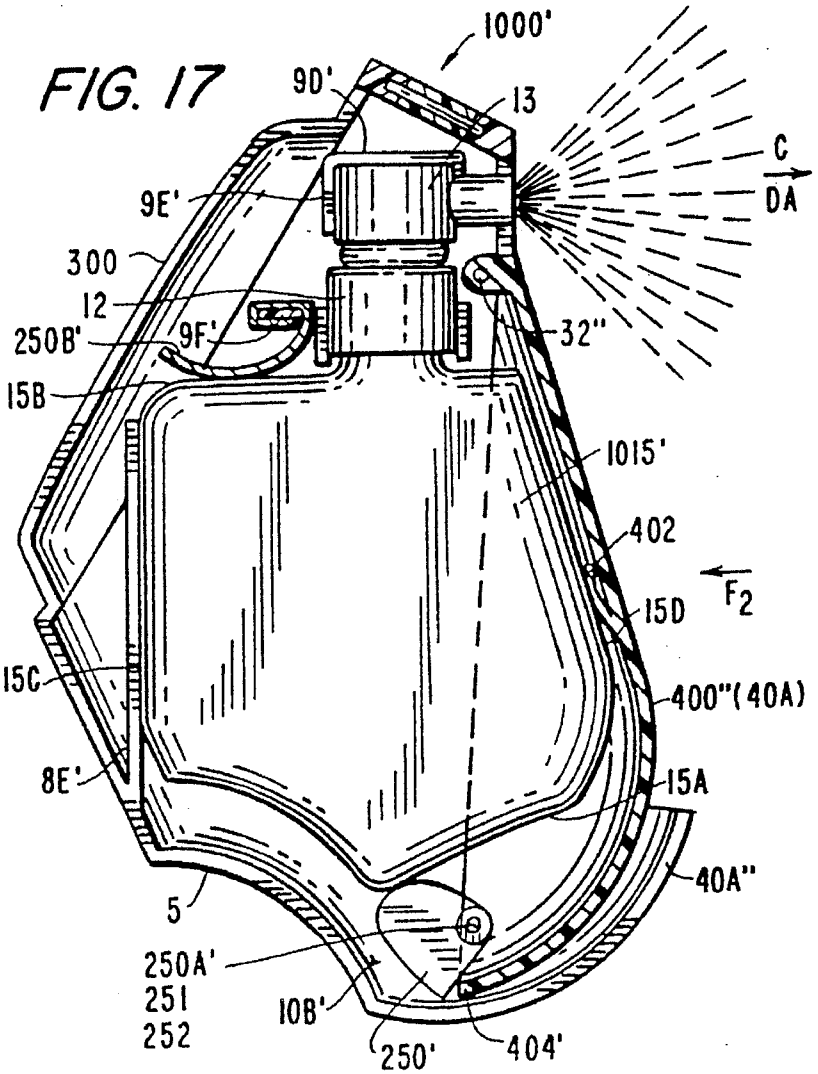
FIGS. 16 to 17 show open side views of a dispenser of the invention, including another design for moving the vessel towards the pump nozzle and, the dispenser in ordinary and operational conditions.
Figure 16:
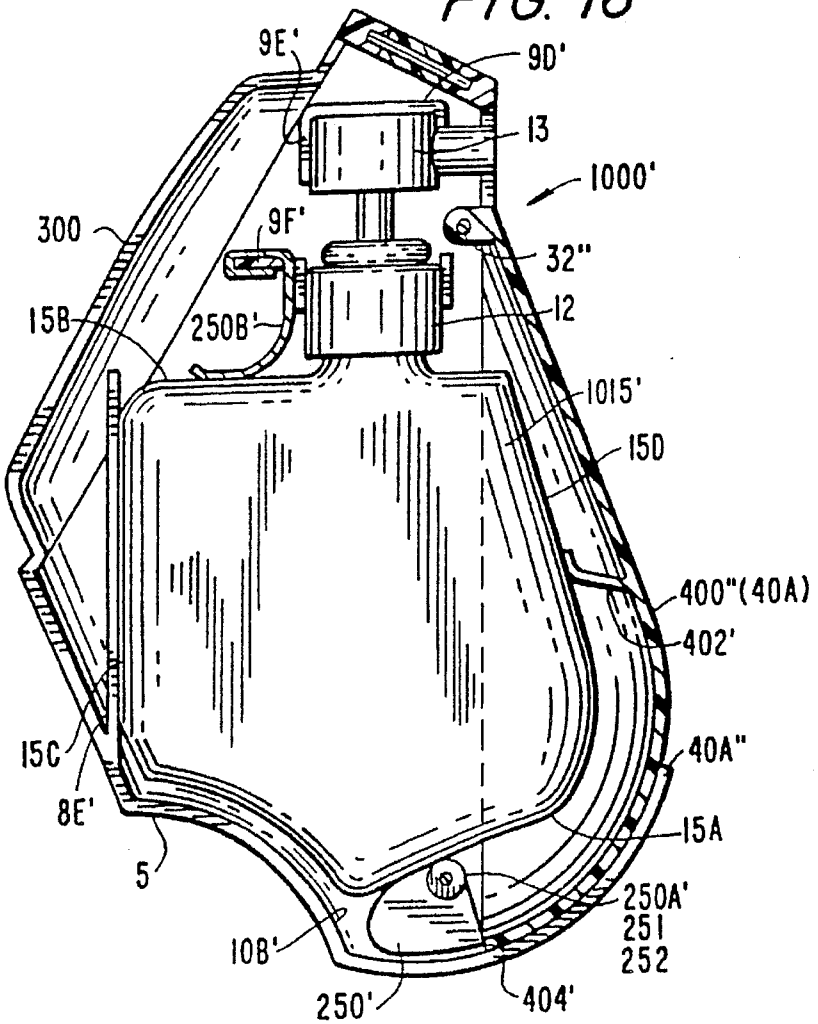

FIGS. 16 and 17 illustrate a further embodiment of the invention in open, cross-sectional, views, with FIG. 16 showing dispenser 1000' at rest and, FIG. 17 showing dispenser 1000' in an operational state. In these Figures, the view is into housing half 10B'. In this embodiment, face 300 (push bar 30 in earlier-described embodiments) is fixed in place. Rising upwardly in housing half 10B' from the inner surface of groove 5 adjacent push face 300 is ledge 8E' against which rests bottle side 15C. On the other side of housing half 10B' is push bar 400' which is movable by pivoting at hinge 32". Push bar 400' has flexible member 402' extending from about the mid-section of the inner wall of push bar 400 towards and resting against bottle side 15D. The lower edge 404' of push bar 400, in the bottom of housing half 10B', is contacting cam 250'.

Cam 250' is located in the bottom of housing half 10A, adjacent the inner surface of groove 5 opposite ledge 8E'. Cam 250' is movable by pivoting at hinge 250A' which includes opening 251 and pin 252 therethrough. Cam 250' is somewhat elliptical in shape, having a flat surface contacting edge 404'. Hinge 250A' is positioned near the flat surface of cam 250', above the point of contact with edge 404'.

At the upper end of the bottle is screw cap 12 against which rests against somewhat "J" shaped spring member 250B' set in the upper portion of housing half 10B'. Spring member 250B' also contacts bottle upper surface 15B. Spring member 250B' is described as being somewhat "J" shaped in that an upper head thereof is wound about ledge 9F', protruding outwardly from the inside of upper housing half 10B', adjacent screw cup 12 (towards face 300), like the head or left side portion of the head of the letter "J". From this upper head, spring member 250B' then extends downwardly. This downward portion rests against screw cap 12. The downward portion of spring member 250B', like the letter "J", extends to a curved portion. The outer surface of the curved portion contacts bottle upper surface 15B. Above screw cap 12 is spray nozzle 13 which is held in place in housing half 10B by perpendicularly attached ledges 9D' and 9E' which are connected the upper inside portion of housing half 10B'. Ledge 9D' is at the top of spray nozzle 13 and, ledge 9E" at the side of spray nozzle 13, opposite the side from which liquid dispenses.

In operation, force $F_2$ from the user causes push bar 400" to move away from face 40A'. Edge 404' is pushed against cam 250' to rotate cam 250'. Flexible member 402' collapses between push bar 400" (inner face) and bottle side 15D. The rotation of cam 250' against bottle 1015' causes bottle 1015' to move upwardly, thereby compressing spring member 250B' and, causing spray (C, DA) to dispense from spray nozzle 13 (See FIG. 17). Upon release of force $F_2$, spring member 250B' and flexible member 402' release from their compressed states, and, with the spring in spray nozzle 13, cause bottle 1015' and push bar 400", respectively, to return to their original positions (FIG. 16). This causes cam 250' to also return to its original position as edge 404' moves away from cam 250'.

Figure 19:
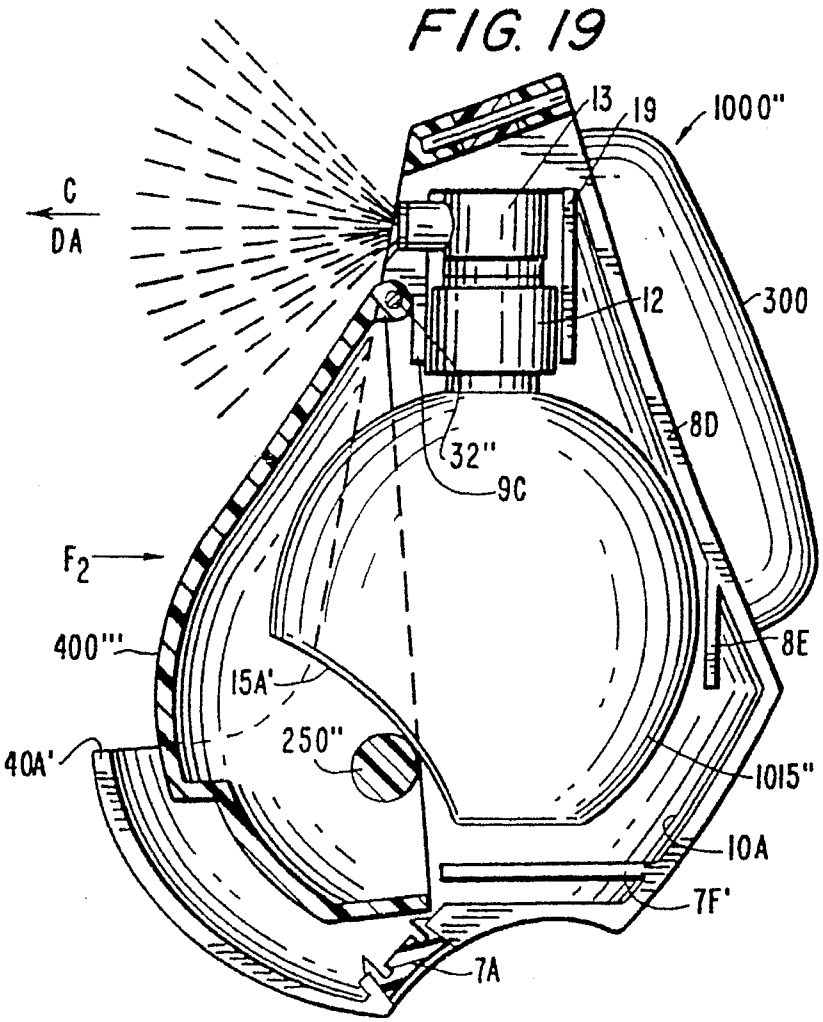
FIGS. 18 and 19 show open side views of a dispenser of the invention, including yet another design for moving the vessel towards the pump nozzle and, the dispenser in ordinary and operational conditions; and, FIGS. 20 and 21 show open views of a dispenser of the invention, including a further design for moving the vessel towards the pump nozzle and, the dispenser in ordinary and operational conditions.
Figure 18:
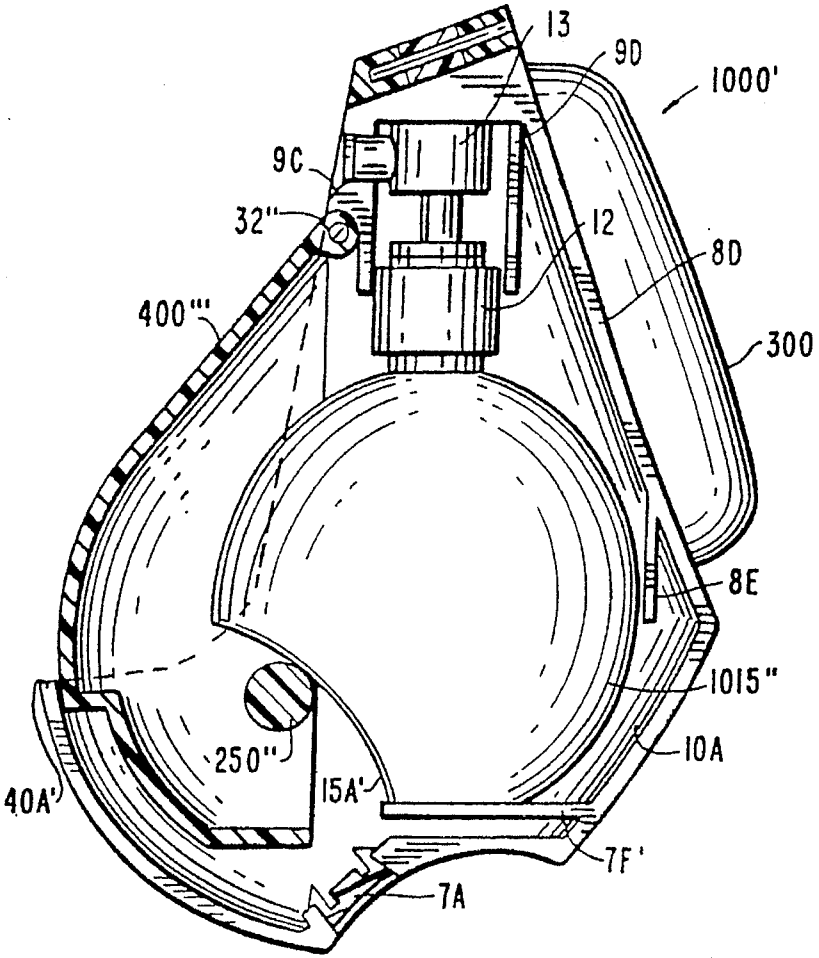

FIGS. 18 and 19 illustrate yet another embodiment of the invention. In FIGS. 18 and 19, dispenser 1000" is shown in open, cross-sectional, views, with FIG. 18 showing dispenser 1000" at rest and, FIG. 19 showing dispenser 1000" in operational condition. Dispenser 1000" is similar to dispenser 1000 of FIGS. 13 to 15 in that face 300 is fixed along edge 8D, spray nozzle 13 is kept in place by ledges 9C and 9D, push bar 400'" is movable, away from face 40A' by pivoting at hinge 32" and, bottle 1015", at the side adjacent face 300, rests against ledge 8E, especially when dispenser 1000" is at rest. Dispenser 1000" at its lower portion has a horizontal platform 7F' upon which bottle 1015" rests when dispenser 1000" is at rest (FIG. 18). In contrast to the cam concept of FIGS. 16 to 17, dispenser 1000" contains cam 250" which is fixed in the lower inner portion of push bar 400'", and rests against curved lower bottle surface 15A'.

In operation, force $F_2$ causes push bar 400'" to move away from face 40A', and, cam 250" to move radially, following the course of an imaginary radius (not shown) extending from hinge 32". The radial movement of cam 250" against curved lower bottle surface 15A' causes bottle 1015" to rise towards spray nozzle 13, which thereby dispenses the liquid within bottle 1015". Release of force $F_2$ allows the spring in spray nozzle 13 to force push bar 400" and bottle 1015" to return to their original positions. Of course, leaf springs, a spring lever, or both can be provided to assist the spring in spray nozzle 13.

Figure 21:
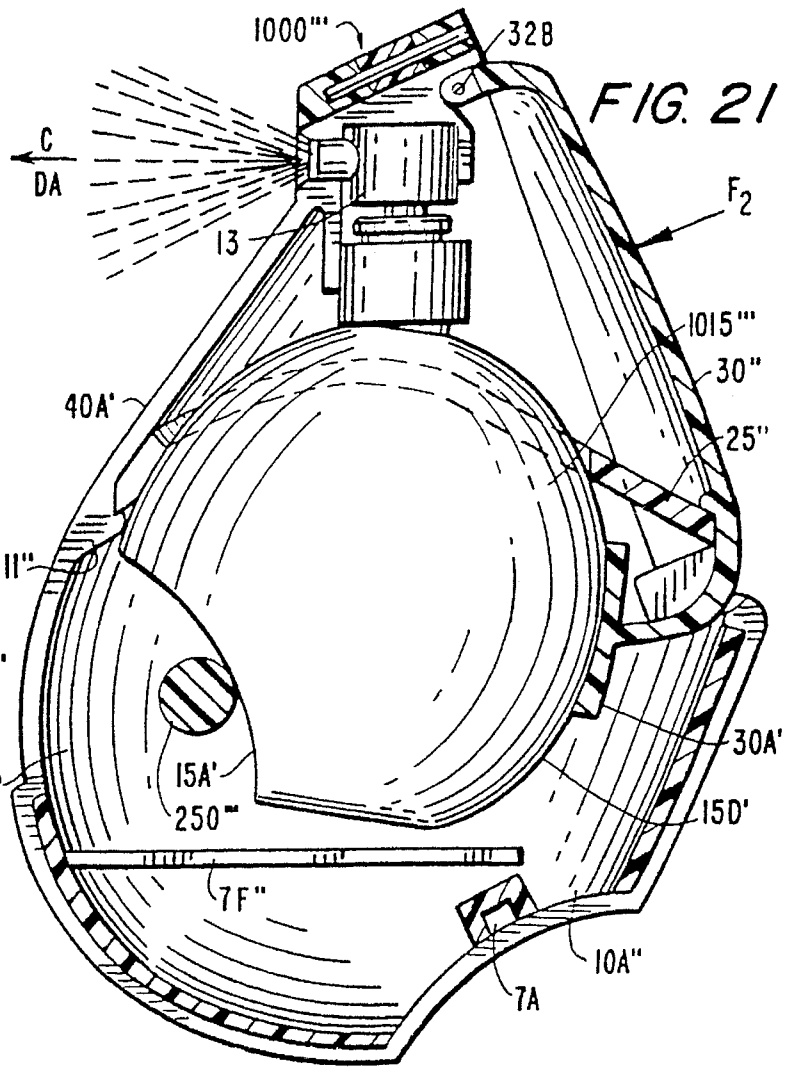
Figure 20:
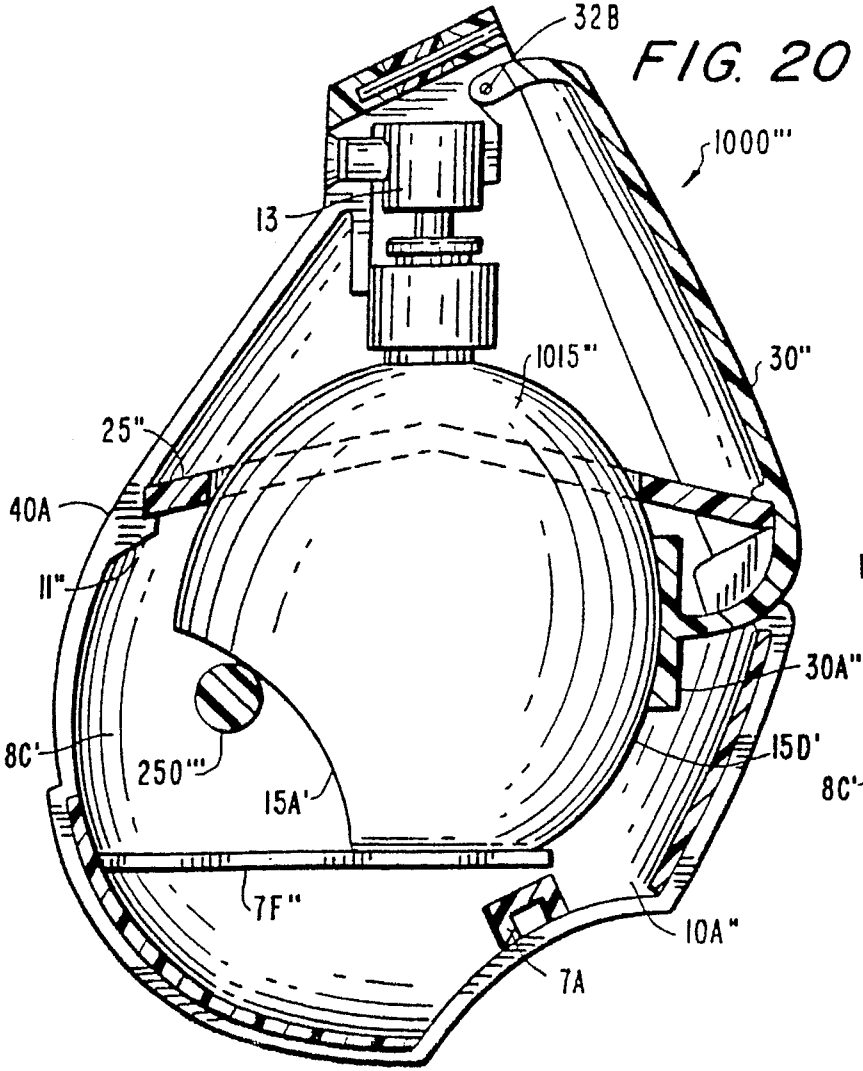

Considering the embodiments of FIGS. 1 to 4, 5, 6 and 7 to 12, in combination with the embodiment of FIGS. 18 and 19, leads to the embodiment illustrated in FIGS. 20 and 21 which show in open, cross-sectional, view dispenser 1000''' of the invention. FIG. 20 shows dispenser 1000''' in a non-operating state (or at rest) and, FIG. 21 shows dispenser 1000''' in an operational state.

In dispenser 1000''', like the embodiments of FIGS. 1 to 4, 5, 6 and 7 to 12, push bar 30'' is hinged to housing 10, pivoting about pin 32B in response to force $F_2$ from a user. Connected to the lower portion of housing half 10A'' of dispenser 1000''' is a horizontal platform 7F'', upon which bottle 1015''' rests in the non-operating state (FIG. 20) Connected to and extending outwardly from inner surface 8C' of housing half 10A'' is cam 250'''. Cam 250''' is fixed in place about midway between the top and bottom of dispenser 1000''', but offset towards face 40A. Curved lower bottle surface 15A' rests against cam 250'''.

Push bar 30'', at its lower portion includes bar 30A'' which contacts bottle 1015''' at side 15D', opposite surface 15A'. Dispenser 1000''' as illustrated in FIGS. 20 and 21 includes spring lever 25'' positioned around bottle 1015''' and between nib 11'' on inner surface 8C' of face 40A (See FIGS. 3 and 5 and discussion thereof, above) and the interior surface of push bar 30''. Spring lever 25'' is optional and, need not be included and can be omitted.

In dispenser 1000''', when force $F_2$ is applied to push bar 30'', bottle 1015''' moves radially against fixed cam 250''', following the course of an imaginary radius (not shown) extending from pin 32B The radial movement of bottle 1015''', particularly of curved lower surface 15A', against fixed cam 250''', causes bottle 1015''' to rise within the dispenser, off platform 7F'' and toward spray nozzle 13, thereby causing spray to dispense. The release of force $F_2$ allows the spring lever 25'' and the spring in spray dispenser nozzle 13 to force bottle 1015''' and push bar 30'' to return to their original positions (FIG. 20). Since spring lever 25'' is optional, the spring in spray dispenser nozzle 13, alone, may be employed to return bottle 1015''' and push bar 30'' to their original positions. Of course, in FIGS. 18 to 21, curved surface 15A' can be a slanted or angled surface (as opposed to curved) to achieve the same effect. Likewise, leaf springs may be employed in the embodiments of FIGS. 18 to 21.

The means for preventing accidental spray discussed above in connection with FIGS. 1 to 4, 5, 6 and 7 to 12 (e.g., cap, lock for push bar, rigidity of spring lever, spring member and/or leaf springs, etc.) can be employed in the embodiments of FIGS. 4A and 13 to 21.

Thus, the invention comprehends alternative means to move the bottle towards the pump nozzle. However, the illustrated embodiments are preferred as they achieve movement of bottle 15, 15'', 115, 1015, 1015', 1015'' or 1015''' with elegant simplicity and few mechanical parts.

As can be further appreciated from the foregoing description and the illustrated embodiments, the dispenser of the invention does not necessarily require the spray activator being located at the top of the dispenser or, that the housing have a "bottom surface" that is substantially parallel to the bottom of the bottle. It is also appreciated that the invention allows freedom in the symmetry of the dispenser. For instance, in the illustrated embodiments, if dispenser 1, 100, 100', 100'', 100''', 1000, 1000', 1000'' or 1000''' is set on a substantially flat surface, the dispenser will rest on a side, not on a "bottom surface" Likewise, dispenser 1, 100, 100', 100'', 100''', 1000, 1000' 1000'', or 1000''' is free to have a novel shape.

The invention also comprehends some movement of pump spray nozzle 13 within the housing, such as housing 10; for instance, in conjunction with upward movement of bottle 15, 15'', 115, 1015, 1015', 1015'', 1015''' during operation. Thus, the terms "substantially stationary" and "at least substantially stationary." For clarity, "at least substantially stationary" with respect to the pump nozzle means that the pump nozzle is at least substantially stationary; that is, it can also be stationary, or, it can move somewhat.

Having thus described in detail preferred embodiments of the present invention, it is to be understood that the invention defined by the appended claims is not to be limited by particular details set forth in the above-description, as many apparent variations thereof are possible without departing from the spirit or scope of the present invention

What is claimed is:

1. A method for pump spray dispensing a liquid from a vessel comprising the steps of 1) maintaining a pump spray dispensing means of the vessel for dispensing a liquid in a substantially stationary position in a portable housing for the vessel; and, 2) moving the vessel relative to said pump spray dispensing means in response to an activating force applied by a user along a first axis to cause the liquid to dispense from the pump spray dispensing means along a second axis wherein there is an angle $\alpha$ between the first and second axes and $\alpha$ is greater than 90° and less than about 270° or greater than about 270° and less than about 90°; and, there is a pumping axis of the pump spray dispensing means which is substantially perpendicular to the first axis.

2. The method of claim 1, comprising the steps of 1) maintaining the dispensing means which is a pump spray nozzle in a substantially stationary position in the housing which is adapted to hold the pump spray nozzle in a substantially stationary position; and, 2) providing an activating force to a movable member on the surface of the housing to move the vessel towards the pump spray nozzle to cause the pump spray nozzle to dispense the liquid

3. A portable dispenser for pump spray dispensing a liquid from a vessel comprising:

a housing adapted to receive the vessel, said vessel having pump spray means for dispensing the liquid about a first axis and, said housing also adapted to receive the pump spray means for dispensing a liquid and to hold said pump spray dispensing means in at least a substantially stationary position; and means for moving the vessel relative to said pump spray dispensing means to cause the liquid to dispense from the pump spray dispensing means in response to an activating force applied about a second axis; wherein there is an angle $\alpha$ between the first and second axes and, $\alpha$ is greater than 90° and less than 270° or greater than 270° and less than 90°; and, there is a pumping axis of the pump spray dispensing means which is substantially perpendicular to the first axis.

4. A portable dispenser for pump spray dispensing a liquid from a vessel comprising:

a housing adapted to receive the vessel which is provided with a pump spray nozzle, said housing also adapted to hold the pump spray nozzle in at least a substantially stationary position; and, means adapted to be operatively connected to the vessel and the housing for receiving an activating force from a user and moving the vessel relative to the pump spray nozzle in response to the activating force which is applied about a first axis so as to cause the liquid to spray from the nozzle about a second axis; wherein there is an angle $\alpha$ between the first and second axes and, $\alpha$ is greater than 90° and less than 270° or greater than 270° and less than 90°; and, there is a pumping axis of the pump spray nozzle which is substantially perpendicular to the second axis.

5. The dispenser of claim 4, wherein $\alpha$ is between about 345° and about 80° or between about 120° and about 215°.

6. The dispenser of claim 4 wherein the means for moving the vessel comprises means for receiving an activating force from a user and for moving the vessel towards the pump spray nozzle to cause the pump spray nozzle to dispense the liquid in response to the activating force; said means for receiving an activating force which is separate from but operatively connected to means for moving the vessel, the means for receiving an activating force is adapted to receive an activating force from a user of the dispenser and to translate said activating force to said means for moving the vessel, said means for moving the vessel being adapted to receive the activating force and to move the vessel toward the pump spray nozzle to compress the pump spray nozzle and dispense the liquid.

7. The dispenser of claim 4 wherein the means for receiving an activating force and moving the vessel includes a push bar which is moveable by being hingedly connected to the housing.

8. The dispenser of claim 4, wherein said housing is a substantially rigid decorative outer housing surrounding and enclosing the vessel and also surrounding and enclosing the pump spray nozzle, said housing being provided with means defining an opening through which the pump spray nozzle can spray liquid.

9. The dispenser of claim 8, wherein the vessel is a glass bottle adapted to receive a fragrance.

10. The dispenser of claim 8, wherein at least a portion of the spray pump nozzle fits within and is held in a substantially stationary position by means defining a cut-out section provided in the housing.

11. The dispenser of claim 10 wherein the housing comprises a first part and a second part and the first part is connected to the second part such that the housing is selectively openable and closeable.

12. The dispenser of claim 4 wherein the dispenser has an imaginary axis running through the vessel and pump spray nozzle, and the means for receiving an activating force and for moving the vessel includes means within the housing for translating the activating force or a component of the activating force to an upward force along that axis or parallel thereto, there being an angle $\theta$ between the activating force and the upward force.

13. The dispenser of claim 12 wherein $\theta$ is $0° \leqq \theta \leqq 180°$.

14. The dispenser of claim 13 wherein $\theta$ is $60° \leqq \theta \leqq 120°$.

15. The dispenser of claim 14 wherein $\theta$ is $80° \leqq \theta \leqq 100°$.

* * * * *